US006612291B2

(12) United States Patent
Sakamoto

(10) Patent No.: US 6,612,291 B2
(45) Date of Patent: Sep. 2, 2003

(54) FUEL INJECTION CONTROLLING SYSTEM FOR A DIESEL ENGINE

(75) Inventor: Hiroki Sakamoto, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 7 days.

(21) Appl. No.: 09/878,326

(22) Filed: Jun. 12, 2001

(65) Prior Publication Data

US 2002/0020396 A1 Feb. 21, 2002

(30) Foreign Application Priority Data

Jun. 12, 2000 (JP) ..... 2000-174945

(51) Int. Cl.[7] ..... F02M 51/00

(52) U.S. Cl. ..... 123/492; 123/478; 123/436; 701/104; 701/115

(58) Field of Search ..... 123/136, 492, 123/493, 698, 675, 682, 559.1, 478, 568.11, 568.14, 568.21; 701/103, 104, 108, 110, 115

(56) References Cited

U.S. PATENT DOCUMENTS

| | | | | |
|---|---|---|---|---|
| 6,209,515 B1 | * | 4/2001 | Gotoh et al. | 123/305 |
| 6,279,551 B1 | * | 8/2001 | Iwano et al. | 123/564 |
| 6,298,299 B1 | * | 10/2001 | Itoyama et al. | 701/101 |

FOREIGN PATENT DOCUMENTS

| | | | | |
|---|---|---|---|---|
| JP | 264786 | * | 9/1994 | F02D/41/04 |
| JP | 8-86251 | | 4/1996 | |
| JP | 9-88704 | | 3/1997 | |
| JP | 9-242595 | | 9/1997 | |
| JP | 324662 | * | 12/1997 | F02D/41/04 |
| JP | 11-141372 | | 5/1999 | |
| JP | 11-229850 | | 8/1999 | |
| JP | 315737 | * | 11/1999 | F02D/41/04 |
| JP | 2000-240488 | | 9/2000 | |

* cited by examiner

*Primary Examiner*—Henry C. Yuen
*Assistant Examiner*—Hai Huynh
(74) *Attorney, Agent, or Firm*—Foley & Lardner

(57) ABSTRACT

A fuel injection controller for a diesel engine, having a control unit which conducts computation to determine total fresh intake air amount per a cylinder through computation of a sum of a residue amount of fresh air remaining in the exhaust gas entering the engine cylinder and the computed intake air amount, to obtain an uppermost fuel injection amount based on such total amount, which is defined as a basic limitative smoke generating fuel injection amount, to store the basic limitative amount upon judging whether or not the engine comes into either accelerating or decelerating, to compare the stored basic limitative amount and the basic limitative amount computed during accelerating or decelerating thereby determining a desired limitative amount from judgment of the accelerating or decelerating, and to prevent an objective fuel injection amount to be actually supplied to the engine from exceeding the desired amount.

15 Claims, 14 Drawing Sheets

CONTROL UNIT
ATMOSPHERE
VACUUM PUMP
COMPRESSOR
1
2
3
3a
4
5
6
7
7a
8
9
10
14
16
17
25
33
34
37
38
39
41
42
52
53
54

FUEL INJECTION CONTROLLING SYSTEM FOR A DIESEL ENGINE

BACKGROUND OF THE INVENTION

1. Field of the Invention

The present invention relates to a fuel injection controlling system for a diesel engine. More particularly, it relates to a fuel injection controlling system for not exclusively but preferably a multi-cylinder type diesel engine having an exhaust gas recirculating system (an EGRsystem), i.e., a system used for recirculating a part of the exhaust gas into an intake passage of the multi-cylinder type diesel engine. The recirculated exhaust gas will be hereinafter referred to as EGR gas.

2. Background Information

Generally, in a diesel engine, when an amount of fuel injection is increased, there often occurs a lack of air to be supplied to the engine together with the increased fuel to thereby result in a generation of smoke. Therefore, a limit to the increase in the amount of fuel injection is predetermined as a smoke-generating limit, and a controlling is conducted to prevent an amount of fuel injection from increasing beyond the smoke-generating limit. In other words, an amount of fuel injection is always controlled lest it should exceed a limitative smoke generating fuel injection amount. At this stage, combustion is usually taken place in the diesel engine under such a condition that the air-fuel ratio is somewhat leaner than the stoichiometric air-fuel ratio, that is the amount of the intake air into the diesel engine is somewhat larger than that necessary for constituting the stoichiometric air-fuel ratio. Thus, a part of the fresh intake air remains in the EGR gas while permitting some amount of residue oxygen gas to be left in the EGR gas. Therefore, a fuel injection controller has been proposed by which computation of the limitative smoke generating fuel injection amount is performed by taking into account the remaining amount of fresh air in the EGR gas, which produces the above-mentioned residue oxygen gas (Japanese laid-open Patent Publication No. 9-242595 should be referred to).

In the fuel injection controller of the prior art, an amount of intake air Qac entering each cylinder (it will be hereinafter referred to as a cylinder intake air) with respect to an amount of air measured by an airflow meter is computed by using approximation of dynamics of air according to a distance from the air-flow meter to the cylinder, made by a primary delay. Similarly, a suction amount Qec of the ERG gas for each cylinder (it will be hereinafter referred to as a cylinder suction amount of ERG gas) is computed by using approximation of dynamics of air according to a distance from an ERG valve to the cylinder (this distance is smaller than the foregoing distance), made by a primary delay. Then, assuming that the residue amount of air within the cylinder suction amount of EGR gas Qec and the afore-mentioned cylinder intake air amount Qac are both used again for the cylinder combustion, the total amount of the fresh intake air per each cylinder (=Qac+Qec×KOR, where KOR is a constant indicating a ratio of the residue fresh air) is computed. Further, on the basis of the computed total amount of the fresh intake air, the amount of fuel injection determined by a limitative excess coefficient of air is computed to obtain the smoke-generating limit of the fuel injection amount. Thus, when an objective or target amount of fuel injection for each cylinder computed in response to driving conditions of a vehicle exceeds the above-mentioned smoke-generating limit of the fuel injection amount, a controlling is performed so as to suppress the objective amount of fuel injection for each cylinder to the smoke-generating limit of the fuel injection amount.

Nevertheless, unlike a gasoline engine, a diesel engine is constructed and operated so that supply of fuel by injection occurs ahead of supercharging of the air. Thus, when a vehicle mounting thereon the diesel engine is accelerated, the rotating speed of the engine is increased in advance of an increase in the amount of the air due to the supercharging. As a result, the total amount of the fresh air per each cylinder is reduced at an initial stage of the vehicle acceleration. Further, since the airflow meter and the ERG valve are disposed at different positions with regard to the engine, a distance from each cylinder to the airflow meter is different from that from each cylinder to the ERG valve. Thus, when the dynamics of the air is taken into account with respect to the above-mentioned distances from the cylinder to the airflow meter and the ERG valve, the cylinder suction amount of ERG gas Qec is reduced before the cylinder intake air amount Qac is increased. Therefore, the total amount of air as per each cylinder changes so that it is once reduced and thereafter increased. Thus, if the amount of fuel injection is suppressed to the limitative smoke generating amount of the fuel injection which is computed based on the above-mentioned total amount of air as per each cylinder, the suppressed limitative smoke-generating amount of the fuel injection must also change in such a manner that it is temporarily reduced after the fuel injection under a given limitative smoke generating amount of the fuel injection is once carried out, and thereafter it is increased. Therefore, the temporary reduction in the amount of fuel injection during engine acceleration will causes a change in a torque exhibited by the engine, and accordingly an accelerating drivability of a vehicle, especially a vehicle with a manual transmission is deteriorated.

A further description of the prior art fuel injection controller will be provided hereinbelow with reference to FIG. 22.

As shown in FIG. 22, when an accelerator pedal is pressed down at a time t1, a corresponding response occurs rather quickly in the cylinder suction ERG amount Qec by taking into account the dynamics of the air, and terminates at a time t5. However, in comparison with the above-mentioned cylinder suction ERG amount Qec, a response occurs at a later time t3 in the cylinder intake air amount Qac. A difference in the starting times between the respective responses causes a temporary reduction in the total amount of the fresh air as per each cylinder as depicted by a fourth curve from the top in FIG. 22. Thus, when the limitative smoke generating fuel injection amount QSMOKEN in proportion to the above total amount of the fresh air as per each cylinder is computed, a temporary reduction in the limitative smoke-generating fuel injection amount QSMOKEN occurs as depicted by a fifth curve in solid line from the top in FIG. 22. Therefore, if a requested amount of fuel injection (an objective fuel injection amount Qsol1 indicated by a single dotted and dashed line) in compliance with an opening degree of an accelerator system of a vehicle is limited to the limitative smoke-generating fuel injection amount QSMOKEN, the limitative smoke-generating fuel injection amount QSMOKEN corresponds to an actual fuel amount injected into each cylinder. Since an output torque exerted by the engine is in proportion to the actual fuel amount, a temporary reduction appears in the output torque exerted by the engine. As a result, in the case of a vehicle provided with a manual transmission, the temporary reduction in the output torque, that is the torque fluctuation causes an operating shock, i.e., a so-called stumbling which is unfavorable to a vehicle driver and/or a passenger.

In the case of a vehicle provided with a torque converter, torque fluctuation is absorbed by the torque converter, and accordingly a temporary reduction in the output torque does not provide any adverse affect on the motion of the vehicle. However, when the lockup mechanism is in operation, the vehicle provided with the torque converter may be exposed to the operating shock in a manner similar to the vehicle provided with the manual transmission.

Although the foregoing description of the prior art fuel injection controller is directed to the case where a diesel engine is in its accelerating operation, a like problem such as the stumbling phenomenon and the unfavorable smoke generation appears in the case where the diesel engine is in its another operating condition in which the engine is re-accelerated immediately after being decelerating. Namely, as illustrated in FIG. 23, during the deceleration of the diesel engine, the limitative smoke generating fuel injection amount QSMOKEN temporarily increases on the contrary to the acceleration of the vehicle engine (see a fifth solid line curve from the top of FIG. 23). Nevertheless, the amount of fuel injection Qsol1 is not suppressed by the increase of the limitative smoke generating fuel injection amount QSMOKEN during the decelerating operation of the diesel engine. This is because the limitative smoke generating fuel injection amount QSMOKEN determines the upper limit of the fuel injection amount, but the fuel injection amount Qsol1 does not exceed the upper limit thereof during the deceleration of the diesel engine (a curve Qsol1 with a single dotted and dashed line in FIG. 23 should be referred to). Nevertheless, when the diesel engine is accelerated immediately after the decelerating operation, the limitative smoke generating fuel injection amount QSMOKEN indicates only a temporary increase due to a delay in an intake amount of the fresh air, while the fuel injection amount Qsol1 which is a map value according to the operating conditions of the diesel engine (i.e., an engine rotating speed and the opening degree of the accelerator system), indicates an immediate increase in response to the operating conditions of the diesel engine. Therefore, when the fuel injection amount Qsol1 increases beyond the limitative smoke generating fuel injection amount QSMOKEN due to the engine acceleration immediately after the deceleration, the above-mentioned temporary increase in the limitative smoke generating fuel injection amount QSMOKEN becomes an actual fuel amount injected into each cylinder of the diesel engine. At this stage, it should be noted that although the upper limit of the fuel injection amount varies to become lower, namely, varies so as to suppress smoke generation from the diesel engine during the aforementioned accelerating stage, the upper limit of the fuel injection amount varies to become larger, namely, varies so as to degrade smoke generation from the diesel engine during the acceleration immediately after the deceleration to thereby cause not only occurrence of a torque shock but also degradation of the smoke generation due to a temporary increase in the amount of fuel injection.

SUMMARY OF THE INVENTION

Accordingly, an object of this invention is to provide a fuel injection controlling system for a diesel engine, which is capable of preventing vehicle accelerating drivability from being degraded when the engine mounted on a vehicle with a manual transmission device is in one of the transient operation stages, more specifically, in an accelerating stage and also when the engine mounted on a vehicle with a torque converter having a lockup mechanism is in an accelerating stage under a locking-up condition.

This object is basically attained by a fuel injection controlling system which is able to store a first limitative smoke generating fuel injection amount at a given judging time during the accelerating operation of the diesel engine, to compare the stored limitative smoke generating fuel injection amount with respective first limitative smoke generating fuel injection amounts computed from time to time even after the given judging time to thereby determine a larger one as a computed second limitative smoke generating fuel injection amount after the given judging time, on the basis of the above comparison, and to regulate an objective amount of fuel injection from the given judging time so as not to exceed the computed second limitative smoke generation fuel injection amount.

Another object of this invention is to provide a fuel injection controlling system for a diesel engine, which is capable of preventing vehicle drivability and smoke generation from the engine from being degraded either when the engine mounted on a vehicle provided with a manual transmission is in another one of the transient operation stages, i.e., an accelerating operation stage immediately after the engine is decelerated or when the engine mounted on a vehicle provided with a torque converter with a lockup mechanism is accelerated immediately after it is decelerated under a lock-up condition.

This object of this invention is attained by a fuel injection controller for a diesel engine which is able to store a first limitative smoke generating fuel injection amount at a given judging time during the decelerating operation of the diesel engine, to compare the stored limitative smoke generating fuel injection amount with respective first limitative smoke generating fuel injection amounts computed from time to time even after the given judging time during the decelerating operation to thereby determine a smaller one as a computed second limitative smoke generating fuel injection amount after the given judging time during the decelerating operation, on the basis of the above, comparison, and to regulate an objective fuel injection amount at a time when an accelerating operation is conducted immediately after the given judging time during the decelerating operation so as not to exceed the computed second limitative smoke generating fuel injection amount from the given judging time during the decelerating operation of the diesel engine.

In accordance with the present invention there is provided a fuel injection controlling system for a diesel engine provided with an intake passage for intake air, a fuel supply system for fuel injected in an engine cylinder, and an EGR passage for exhaust gas recirculation, said fuel injection controlling system comprising:

- a sensor unit that detects an amount of intake air through the intake passage, an amount of exhaust gas through the EGR passage, and a transient operation condition of the engine; and
- a control unit including a computing unit and a memory unit and operatively connected to the sensor unit for determining an objective amount of fuel wherein the control unit:
  - computes an amount of intake air entering the engine cylinder based on the detected amount of intake air;
  - computes a residue amount of fresh air within the detected amount of exhaust gas introduced in the engine cylinder;
  - obtains a sum of the computed amount of intake air and the computed residue amount of fresh air;

computes a basic limitative amount of fuel that defines a smoke generation limit based on the sum;

detects commencement of the transient operation condition;

stores the basic limitative amount of fuel at the instance in which the commencement of the transient operation condition has been detected;

compares the stored basic limitative amount of fuel to the computed basic limitative amount of fuel to obtain a desired limitative amount of fuel;

prevents the objective amount of fuel from exceeding the desired limitative amount of fuel.

Preferably, in one aspect of the present invention, the above-described fuel injection controlling system for a engine is characterized in that when the judgment of the transient operation of the engine conducted by the control unit comprises an operation for judging whether or not the engine comes into accelerating operation, the control unit compares the stored basic limitative amount of fuel injection with the basic limitative amount of fuel injection computed during the accelerating operation of the engine to thereby determine a larger one of the stored basic limitative amount of fuel injection and the computed basic limitative amount as the desired limitative amount of fuel injection from the time of the judgment of the accelerating operation of the engine, and prevents the objective amount of fuel injection from the time of the judgment of the accelerating operation of the engine from exceeding the desired limitative amount of fuel injection so that the diesel engine is constantly supplied with the objective amount of fuel injection.

Preferably, in another aspect of the present invention, the above-described fuel injection controlling system for a diesel engine is characterized in that when the judgment of the predetermined driving operation of the engine conducted by the control unit is conducted to judge whether or not the engine comes into a decelerating operation, the control unit compares the stored basic limitative amount of fuel injection with the basic limitative amount of fuel injection computed during the decelerating operation of the engine to thereby determine a smaller one of the stored basic limitative amount and computed basic limitative amount of fuel injection as the desired limitative amount of fuel injection from the time of the judgment of the decelerating operation of the engine, and prevents the objective amount of fuel injection from a time of accelerating operation of the engine immediately after the time of the judgment of the decelerating operation of the engine from exceeding the desired limitative amount of fuel injection from the time of the judgment of the decelerating operation of the engine so that the engine cylinder of the diesel engine is constantly supplied with the objective amount of fuel injection.

BRIEF DESCRIPTION OF THE DRAWINGS

The above and other objects, features, and advantages of the present invention will become more apparent to those skilled in the art from the ensuing description of the preferred embodiments of the present invention, taken in conjunction with the accompanying drawings wherein.

DESCRIPTION OF THE PREFERRED EMBODIMENTS

Figure 1:
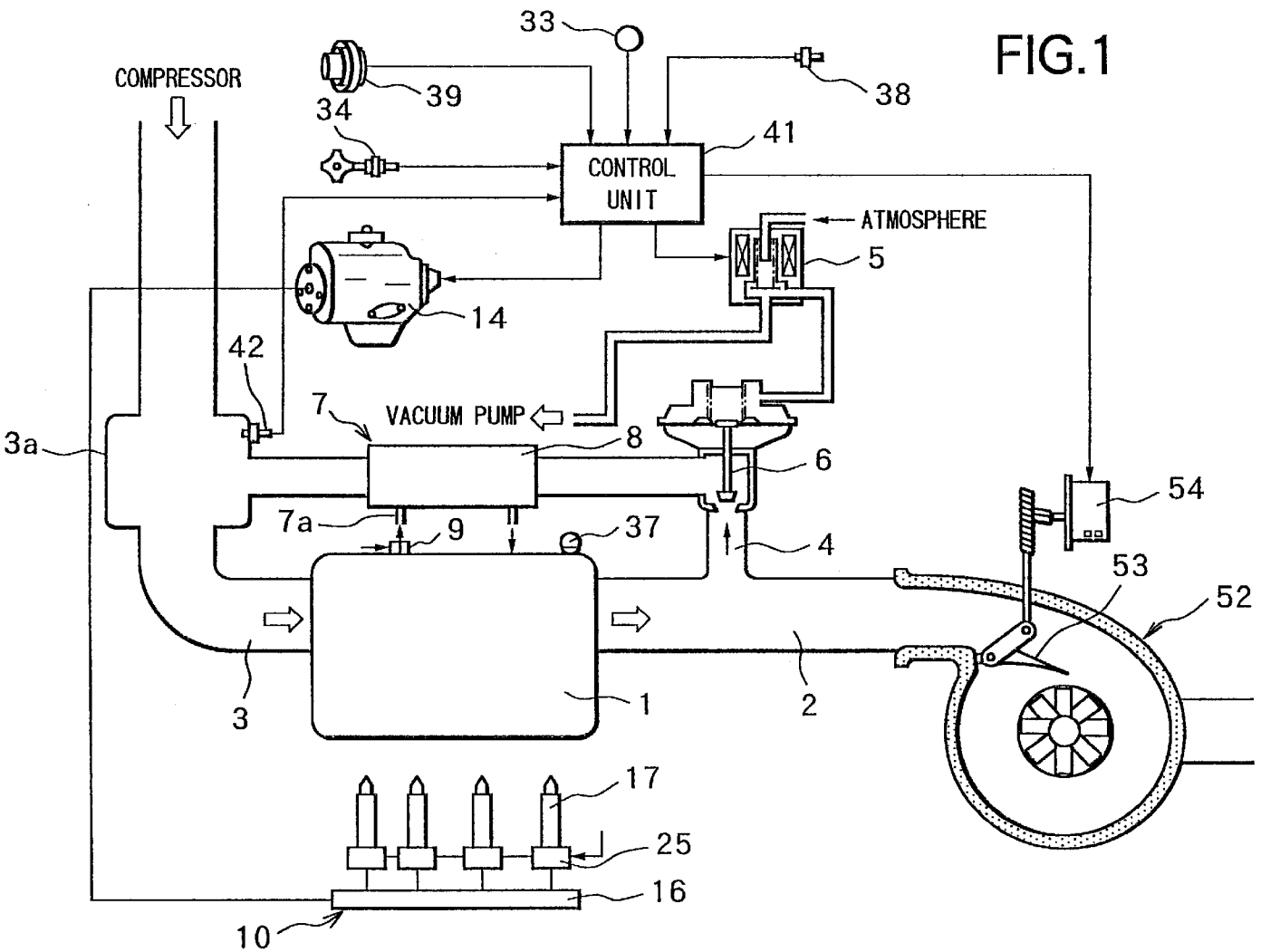
FIG. 1 is a block diagram illustrating an entire system of a fuel injection controller for a diesel engine.

FIG. 1 illustrates an entire system of a fuel injection controller, which controls an amount of fuel injection into a diesel engine, and the system is constructed so as to carry out a low-temperature premixed combustion in which a heat generation pattern takes a form of single stage combustion. It should be noted that the entire system per se of FIG. 1 is disclosed in Japanese Laid-open Patent Publication No. 9-86251.

Referring to FIG. 1, generally, generation of the NOx largely depends on combustion temperature in a diesel engine 1, and accordingly generation of nitrogen oxides (NOx) can be reduced by lowering the combustion temperature. In the premixed combustion, the lowering of the combustion temperature can be achieved by reducing the density of the oxygen (O2) due to an exhaust gas recirculation (ERG). Therefore, a diaphragm type ERG control valve 6 capable of operating so as to respond to a controlling vacuum pressure provided by a pressure control valve 5 is arranged in an ERG passage 4 which is disposed so as to fluidly connect an exhaust passage 2 to a collecting portion 3*a* of an intake passage 3.

The pressure control valve 5 is arranges so as to be operated by a duty control signal supplied by a control unit 41, and operates so as to obtain a predetermined ERG ratio in compliance with the operating conditions of the engine 1 mounted on a vehicle. For example, the ERG ratio is set at 100% at a low rotating speed and in a low load region, and the ERG ratio is gradually reduced in response to an increase in the rotating speed and load of the engine 1. In a high load region, the temperature of the exhaust gas increases, and accordingly when a large amount of ERG gas is recirculated to the intake passage 3 of the engine 1, the temperature of the intake air increases to thereby reduce a lowering effect of the NOx as well as shorten a duration of ignition delay while making it unable to achieve the premixed combustion. Therefore, in the high load region, the ERG ratio is reduced step by step In the intermediate portion of the ERG passage 4, a cooling device 7 for cooling the ERG gas is arranged. The cooling device 7 includes a water jacket 8 formed around the ERG passage 4 to permit a part of engine cooling water (engine coolant) to flow in a circulation, and a flow control valve 9 arranged at an inlet port 7*a* for the engine coolant so as to regulate an amount of circulatory flow of the engine coolant. The cooling device 7 operates in response to a command signal supplied by the control unit 41 so as to increase a cooling rate according to an increase in the recirculating amount of the ERG gas via the control valve 9.

In order to promote the fuel combustion within the diesel cylinder 1, there is provided a swirl control valve (not illustrated in FIG. 1) in the intake passage 3 at a position adjacent to the intake ports. When the swirl control valve is closed by a control signal supplied from the control unit 41 during a low rotating speed and in a low load region, the flow rate of the intake air entering the combustion chambers of the engine 1 increases to produce a swirling of the intake air. The combustion chambers are formed in large-diameter toroidal chambers (not illustrated in FIG. 1) provided with piston cavities, respectively, each having the shape of a cylinder extending from a piston top end toward a piston bottom portion with an unchoked entrance. Each of the toroidal combustion chambers has a bottom portion of which the central part is formed in a conical shape so as to prevent a swirling flow of the intake air, which rotatively enters therein from outside the piston cavity at the end of compression stroke of the piston, from being obstructed, and further to enhance mixing of the fuel with the intake air. The cylindrical piston cavities having the unchoked entrances permit the swirling flow of the intake air, which is produced by the afore-mentioned swirl control valve and so on, to be diffused from the piston cavities toward the outside while the pistons are moving down during the combustion process, and also permit the diffused swirling flow to be maintained outside the piston cavities.

A variable displacement turbosupercharger is arranged in the exhaust passage 2 at a position downstream an opening of the ERG passage 4. The turbosupercharger is constructed by a movable nozzle 53 disposed at a scrolling inlet port of an exhaust gas turbine 52 and driven by a stepping motor 54 of which the operation is controlled by the control unit 41. Namely, the movement of the movable nozzle 53 is regulated by the stepping motor 54 in response to the control signal of the control unit 41, so that a predetermined supercharging pressure can be obtained even when the engine 1 is in the low rotating speed region. Thus, when the rotating speed of the engine 1 is kept low, a controlling operation occurs so that the movable nozzle 53 is moved to its opening position (a slanted position) permitting the exhaust gas to enter the exhaust gas turbine 52 at a high flow rate. On the contrary, when the rotating speed of the engine 1 is kept high, the movable nozzle 53 is moved to its different opening position, i.e., a full open position permitting the exhaust gas to enter the exhaust gas turbine 52 without any flow resistance.

It should be understood that the turbosupercharger might not be a variable displacement type turbosupercharger. Therefore, for the brevity sake, the description will be provided hereinbelow with respect to an embodiment in which a non-variable displacement type turbosupercharger is employed.

The engine 1 is provided with a common-rail fuel injection device 10. The latter mainly includes a fuel tank (not shown in FIG. 1), a fuel supply pump 14, a common rail (a pressure storage chamber) 16, and a plurality of fuel injection nozzles 17 each being provided for each of a plurality of cylinders of the engine 1. The fuel at a high pressure pumped by the fuel supply pump 14 is discharged toward and stored in the common rail 16. The fuel at a high pressure is further supplied to the fuel injection nozzle 17 which accommodates therein a three-way valve 25 capable of controlling the opening and closing movements of needles held in the fuel injection nozzle 17 and of freely regulating the timing of starting and stopping of the fuel injection. The amount of fuel injection is determined by the duration from the starting of the injection to the stopping of the injection and a fuel pressure within the common rail 16. A starting time of the fuel injection can be understood as fuel injection timing. The fuel pressure within the common rail 16 is constantly controlled by a pressure sensor (not shown) and a discharge amount regulating mechanism (not shown) of the fuel supply pump 14 at an optimum pressure level required by the engine 1.

The above-mentioned fuel injection amount, the fuel injection timing and the fuel pressure are all computed and controlled by the control unit 41. Therefore, the control unit 41 includes therein at least an electronic computing unit such as a suitable ECU and a memory unit such as a random access memory (RAM) and a read only memory (ROM). Further, the control unit 41 is arranged to be supplied with various input signals from an accelerator opening degree sensor 33, a different sensor 34 detecting an engine rotating speed and a crank angle, a further sensor (not shown) for discriminating among cylinders, a water-temperature sensor 38, and an air-flow meter 39 arranged in an upstream position in the intake passage 3. On the basis of the input signals, the control unit 41 computes an objective amount of fuel injection and objective fuel injection timing according to an engine rotating speed and an accelerator opening degree. Subsequently, the control unit 41 controls continuation of an ON time of the three-way valves 25 of the respective fuel injection nozzles 17 on the basis of the computed objective amount of fuel injection, and also controls timings to cause an ON condition of the respective three-way valves 25 on the basis of the computed objective fuel injection timing. At this stage, it should be noted that the position of the air-flow meter 39 in the intake passage 3 is arranged so that the distance of the air-flow meter 3 from the intake port side of the engine 1 is far larger than that from the same intake port side of the engine to the EGR control valve 6.

Now, for example, when the engine 1 is operated at a low rotating speed and a low load under a high ERG ratio, the control unit 41 controls the fuel injection timing (the starting time of the fuel injection) so as to be delayed to a time when each piston comes to its top dead center (TDC), in order to prolong the duration of an ignition delay of the injected fuel. The delay of the fuel injection timing permits a temperature within each combustion chamber at a time of ignition to be maintained at a low temperature, and also permits a premixed combustion ratio to be increased. As a result, smoke generation in the region of a high ERG ratio can be suppressed.

On the contrary, when the rotating speed of the engine 1 and the load applied to the engine 1 are increased, a control is conducted so as to advance the fuel injection timing for each cylinder. More specifically, even if the duration of the ignition delay is kept constant, a crank angle of the ignition delay, i.e., an angular value obtained by converting the duration of the ignition delay to a corresponding crank angle is increased in proportion to an increase in the engine rotating speed. Therefore, the fuel injection timing is advanced so that the time of ignition in each combustion chamber may be set at a predetermined time under a low ERG ratio.

The control unit 41 further conducts a feedback control of a fuel pressure prevailing in the common rail 16 via the discharge amount regulating mechanism of the fuel supply pump 14 so that the pressure in the common rail 16 detected by a pressure sensor (not shown in FIG. 1) may coincide with an objective pressure.

On the other hand, when the rate of use of the intake air is lowered due to an increase in the amount of fuel injection, smoke generation occurs. Thus, the control unit 41 determines a given amount of fuel injection by which the smoke generation begins as a limitative smoke generating fuel injection amount, and controls a fuel injection amount injected into each combustion chamber so that it is prevented from exceeding the limitative smoke generating fuel injection amount. At this stage, since the combustion in the engine 1 is taken place under a condition of excessive air, a part of the fresh intake air still remains in the ERG gas. Therefore, the determination of the limitative smoke generating fuel injection amount by the control unit 41 is performed by computation while taking into account the residual fresh intake air within the ERG gas. Namely, the control unit 41 computes a cylinder intake air amount Qac by approximating, by the primary delay, the dynamics of the air according to a distance between the airflow meter 39 and each cylinder with respect to the amount of air measured by the airflow meter 39, and also computes a cylinder suction ERG gas amount Qec by approximating, by the primary delay, the dynamics of the air according to a distance between the ERG control valve 6 and each cylinder (note: the latter distance is smaller than the above-mentioned distance) with respect to the amount of air measured by the airflow meter 39. The control unit 41 further computes a total amount of fresh intake air as per a cylinder by assuming that the residual fresh intake air remaining in the computed cylinder suction ERG gas amount Qec and the aforementioned cylinder intake air amount Qac are again used for the combustion in each cylinder. Then, the control unit 41 further computes the limitative smoke generating fuel injection amount from a fuel injection amount at which a required amount of intake air relative to the limitative excess coefficient can be obtained by the computed total amount of fresh intake air.

Specifically, in the present invention, a limitative smoke generating fuel injection amount at a time a judgment is conducted as to whether or not a vehicle mounting thereon the engine 1 is in an accelerated operation is stored in a memory of the control unit 41, and the stored limitative smoke generating fuel injection amount is compared with each of respective limitative smoke generating fuel injection amounts computed at every cyclic computing time since the above-mentioned time of judgment of the vehicle decelerating operation to thereby determine the larger one as a limitative smoke generating fuel injection amount since the time of judgment of the vehicle accelerating operation on the basis of the above comparison. Then, the control unit 41 further conducts a controlling operation to prevent an objective fuel injection amount since the time of judgment of the vehicle accelerating operation from exceeding the above-mentioned limitative smoke generating fuel injection amount since the time of judgment of the vehicle accelerating operation in order to prevent the accelerating drivability of a vehicle from being deteriorated either when the vehicle is provided with a manual transmission and accelerated or when the vehicle is provided with a torque converter with a lockup mechanism and is accelerated under the locking-up condition.

A further description of the above described various control operations conducted by the control unit 41 is provided hereinbelow with reference to the accompanying flowcharts. It should be noted that the later-described illustrations in FIGS. 2 through 13 and 21 are similar to those disclosed in the Japanese laid-open Patent Publication No. 9-242595, which is incorporated herein by reference only. Accordingly, it should be further noted that the illustrations in FIGS. 14 through 19 are newly incorporated flowcharts and table characteristic graphs with reference to the controlling operations conducted by the control unit 41 in accordance with the present invention.

Figure 2:
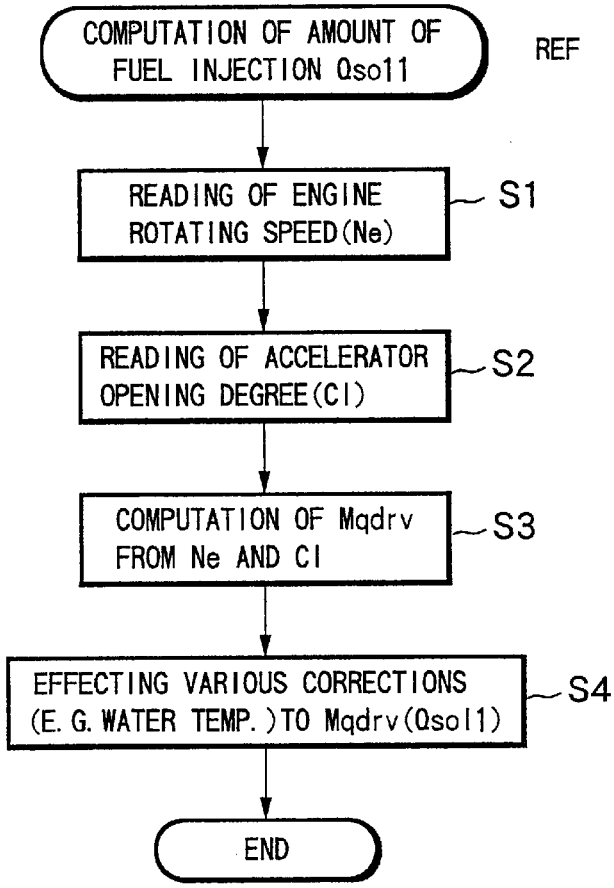
FIG. 2 is a flowchart illustrating a computing routine for computing an objective fuel injection amount.

Now, the flowchart in FIG. 2 illustrates a computing routine to compute an objective fuel injection amount Qsol1, and this computation procedure is conducted every time when a reference signal REF indicative of a reference position signal of a crank angle which is issued at every 180 degrees in the case of a four-cylinder engine, and is issued at every 120 degreee in the case of a six-cylinder engine is inputted into the control unit 41.

Figure 3:
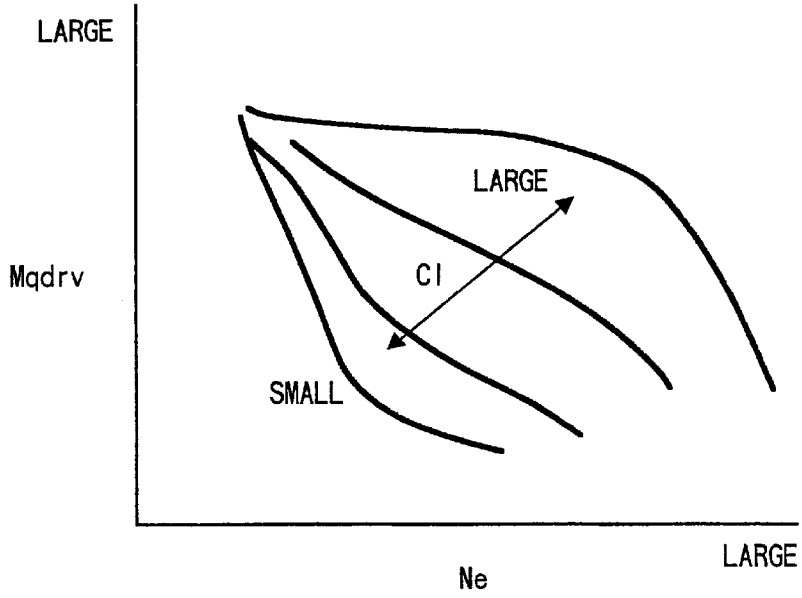
FIG. 3 is a graph indicating a mapping characteristic of a basic fuel injection amount.

In the flowchart of FIG. 2, the engine rotating speed Ne and the accelerator C1 are subsequently read by the control unit 41 in steps 1 and 2. In step 3, searching of the map illustrated in FIG. 3 is conducted on the basis of the Ne and C1 read in step 1 and 2 to thereby compute an accelerator-requiring fuel injection amount Mqdrv. In step 4, correction by fuel addition is conducted to correct the accelerator-requiring fuel injection amount Mqdrv in view of various operating conditions such as the temperature of engine coolant and so forth. The corrected fuel injection amount is set as an objective fuel injection amount Qsol1.

Figure 4:
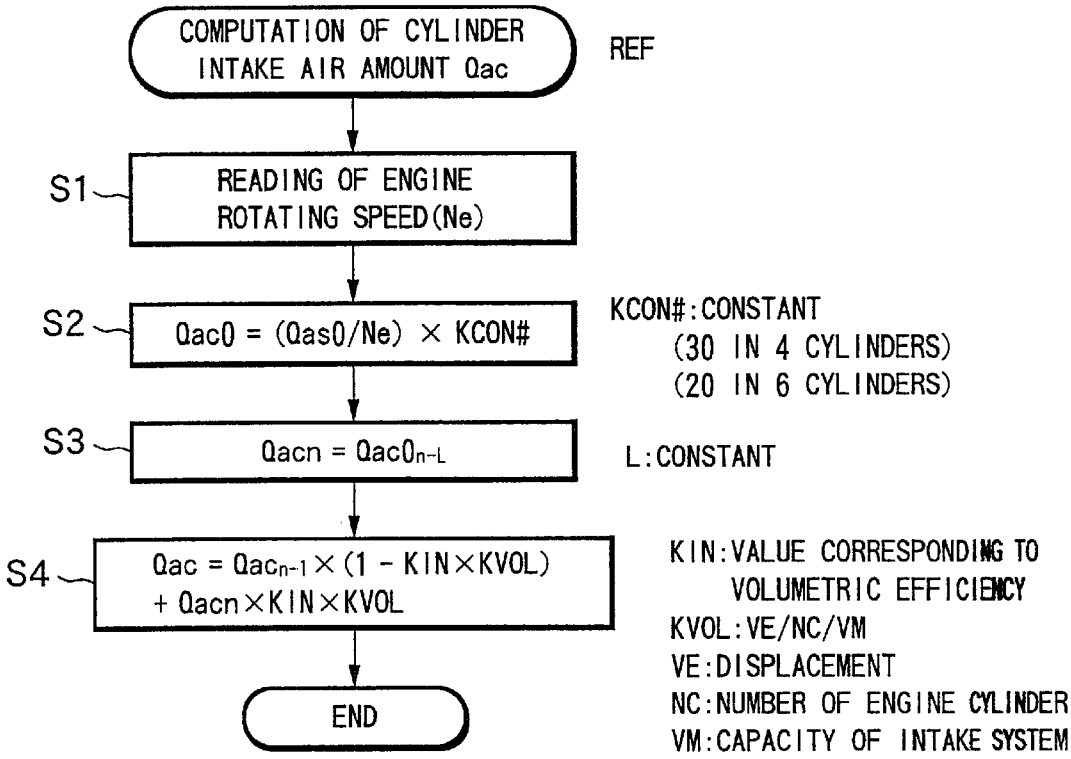
FIG. 4 is a flowchart illustrating a computing routine for computing an amount of cylinder intake air.

The flowchart in FIG. 4 illustrates a routine to compute a cylinder intake air amount Qac. In step 1 of FIG. 4, an engine rotating speed Ne is read. Subsequently, on the basis of the read Ne and an intake air amount Qaso measured by the airflow meter 39, a computation by an equation (1) below is carried out to obtain an intake air amount Qaco per each cylinder.

$$Qac\mathbf{0}=(Qaso/Ne)\times KCON\# \quad (1)$$

where KCON# is a constant.

The above-mentioned airflow meter 39 (see FIG. 1) is arranged in the intake air passage 3 at a position upstream the air compressor. Thus, there occurs a conveying delay in the flow of the intake air due to a distance between the airflow meter 39 and the collecting portion 3*a*. Thus, in order to compensate for the conveying delay of the intake air in step 3, the value of intake air amount Qac0, which was obtained by computation L times ago (L-constant) is employed as an intake air amount Qacn per a cylinder at an entrance position of the collecting portion 3*a* of the intake passage 3. In step 4, a computation on the basis of the employed intake air amount Qacn is carried out according to an equation (2) below (an equation with a primary delay), to obtain an intake air amount per a cylinder, i.e., the cylinder intake air amount Qac.

$$Qac = Qacn - 1 \times (1 - KIN \times KVOL) + Qacn \times KIN \times KVOL \quad (2)$$

where KIN is a value corresponding to a volumetric efficiency, KVOL is VE/NC/VM, VE is an amount of an exhaust gas from the engine, NC is a number of cylinders of the engine, VM is a volume of the entire intake system, and Qacn-1 is the Qac of the preceding time. The resultant Qac can be considered as being appropriately compensated for with respect to the dynamics of air existing between the entrance position of the collecting portion 3*a* and a position of each suction valve.

The description of the measurement or detection of the intake air amount Qas0 of the right side of the equation (1) is provided below with reference to FIG. 5. It should be noted that the computing routine illustrated in the flowchart of FIG. 5 is conducted at every four millisecond (4 ms).

Figure 5:
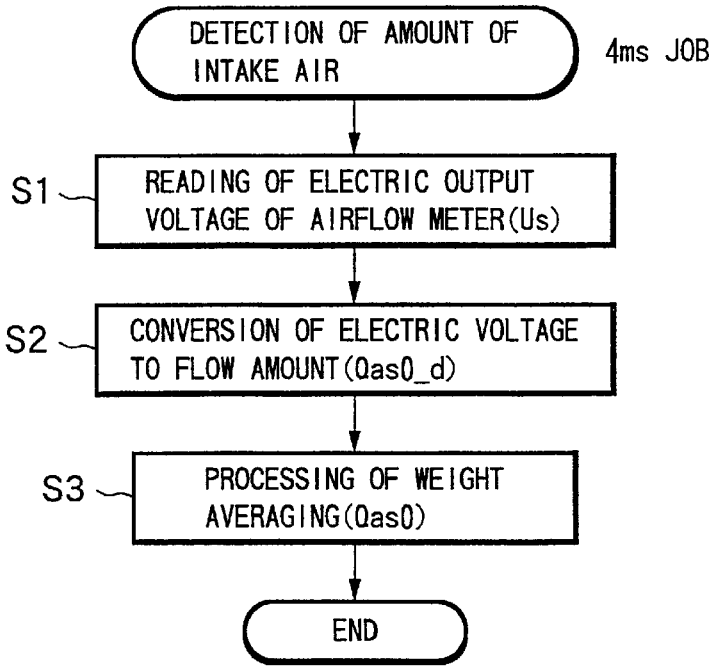
FIG. 5 is a flowchart illustrating a computing routine for detecting an amount of intake air.
Figure 6:
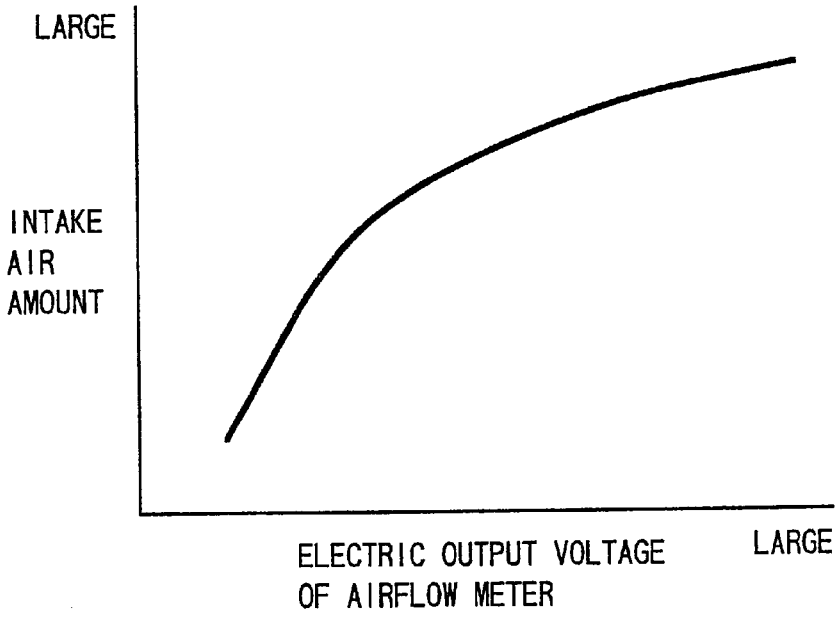
FIG. 6 is a graph indicating a characteristic curve to show a relationship between an electric output voltage of an airflow meter (the abscissa) and the amount of intake air (the ordinate)

In step 1 of FIG. 5, an electric output voltage Us of the airflow meter 39 is read into the control unit 41. In subsequent step 2, a computation of an intake air amount Qas0_d is conducted by, e.g., searching of the conversion table in FIG. 6 indicative of a relationship between the electric output voltage of the airflow meter and the intake air flow rate on the basis of the electric voltage Us of step 1. Further, in step 3, a weight-averaging process is applied to the computed intake air amount Qas0_d, and the resultant weight-averaged value is set as the intake air amount Qas0.

Figure 7:
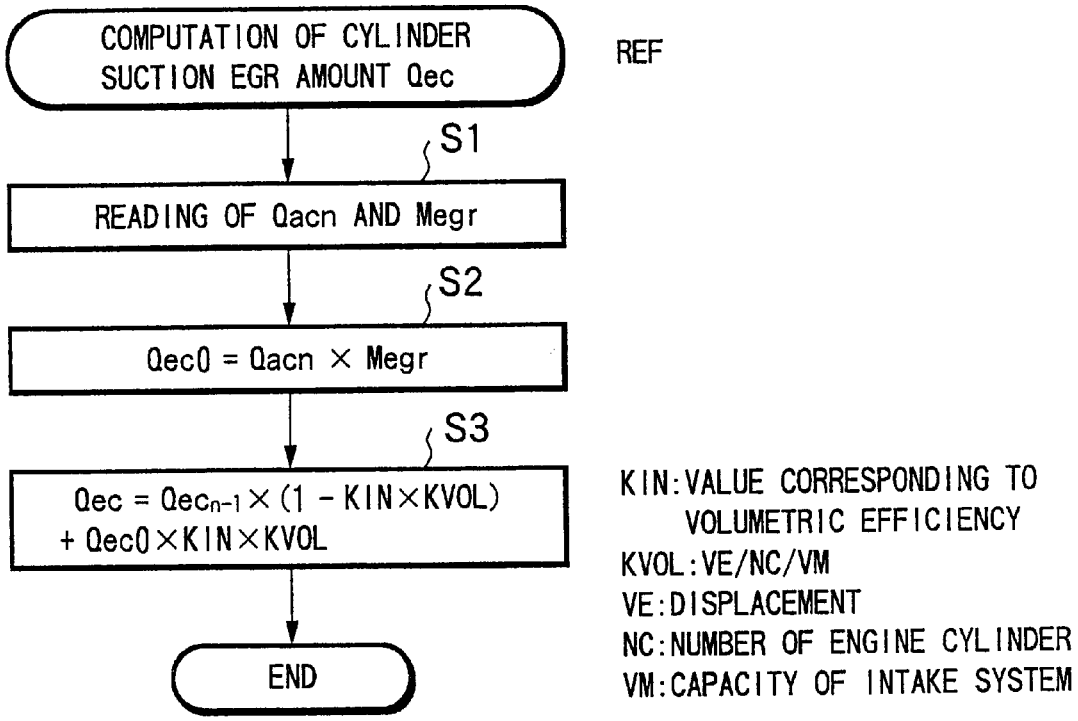
FIG. 7 is a flowchart illustrating a computing routine for computing a suction amount of cylinder ERG gas.
Figure 8:
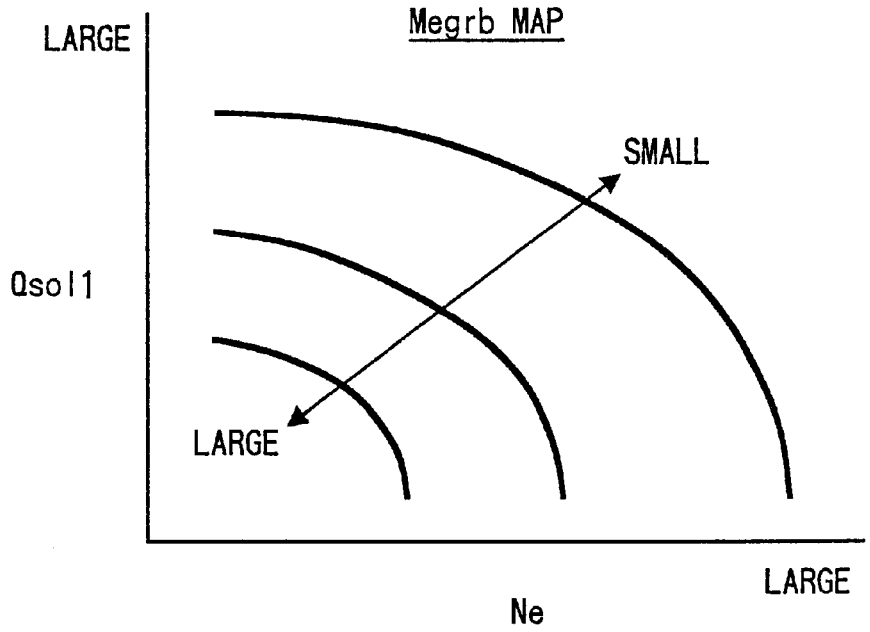
FIG. 8 is a graph indicating a mapping characteristic of a basic objective ratio of ERG.
Figure 9:
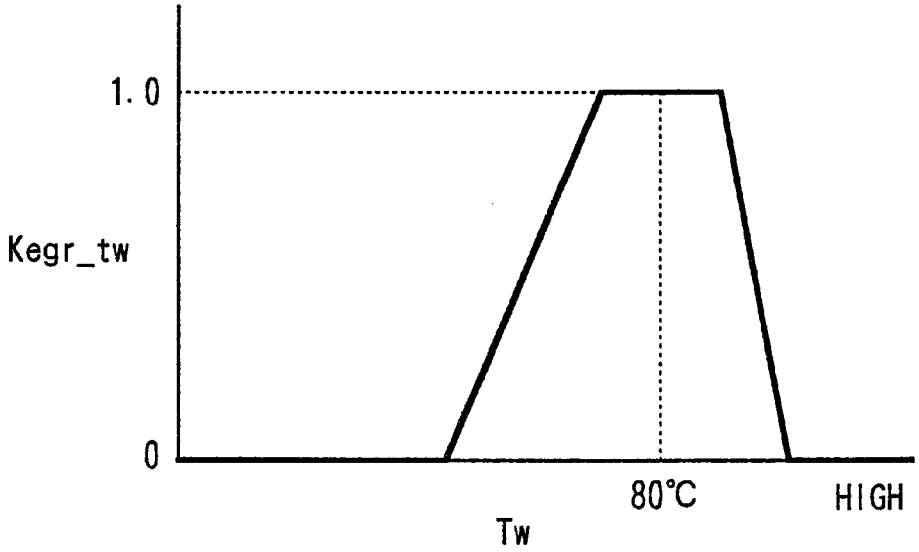
FIG. 9 is a graph indicating a table characteristic of a correction factor of water temperature.

The flowchart of FIG. 7 illustrates a computing routine to compute a cylinder suction ERG gas amount Qec.

In step 1, an intake air amount Qacn per a cylinder at the entrance position of the collecting portion 3*a* (the Qacn has been already computed in step 3 of the flowchart of FIG. 4) and an objective ERG ratio Megr are read by the control unit 41. The objective ERG ratio Megr basically consists of a value obtained by multiplying a basic objective ERG ratio Megrb determined depending on the engine rotating speed Ne and the objective fuel injection amount Qsol1 by a correction factor Kegr_tw (refer to FIG. 9) determined depending on the temperature of the engine coolant. It should be noted that Megr=0 before judgment of complete explosion of the combustion.

In step 2, an ERG gas amount Qec per a cylinder at the entrance position of the collecting portion 3*a* is computed from the afore-mentioned Qacn and Megr according to an equation (3) below.

$$Qec0 = Qacn \times Megr \quad (3)$$

The computed Qec0 is used in step 3 to conduct a computation according to an equation (4) below to thereby obtain a suction ERG gas amount per a cylinder at the position of each intake valve, i.e., a cylinder suction ERG gas amount Qec.

$$Qec = Qecn - 1 \times (1 - KIN \times KVOL) + Qec0 \times KIN \times KVOL \quad (4)$$

where KIN is a value corresponding to a volumetric, KVOL is VE/NC/VM, VE is an amount of exhaust gas from the engine, NC is a number of cylinders of the engine, VM is a volume of the entire intake system, and Qecn-1 is the Qec of the preceding time.

The above computation of the cylinder suction ERG gas amount Qec using the equation (4) is conducted to compensate for the dynamics of air existing between the entrance position of the collecting portion 3*a* of the intake passage 3 and each of the intake valves of the engine 1.

Figure 10:
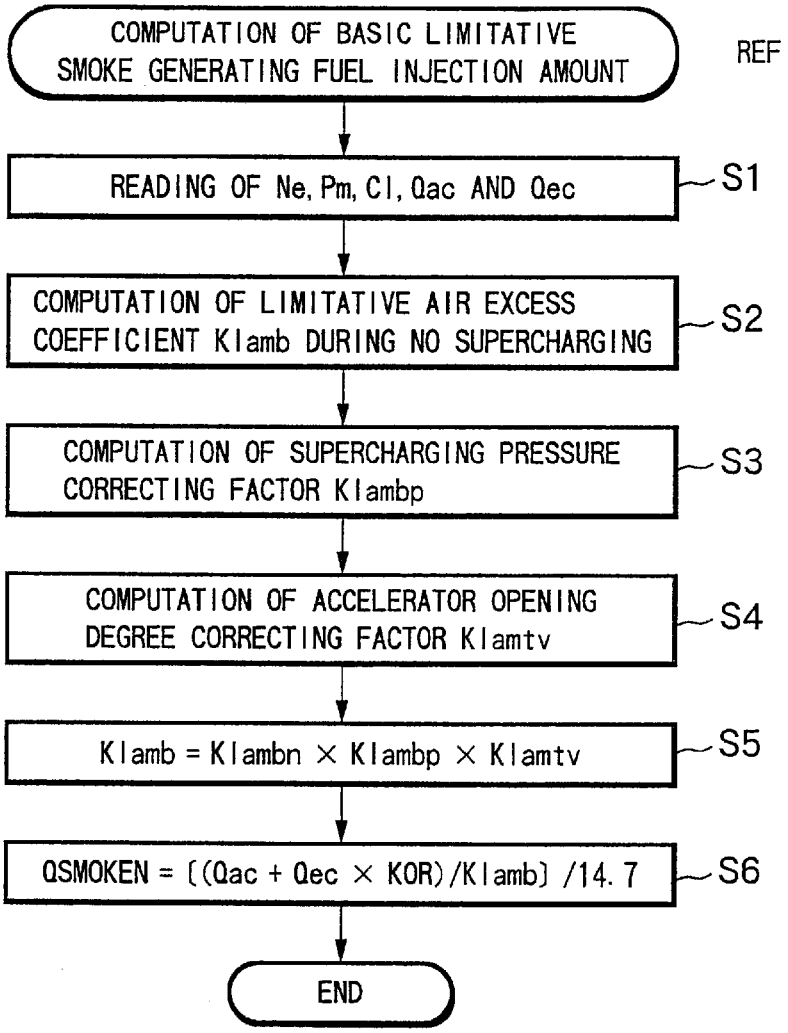
FIG. 10 is a flowchart illustrating a computing routine for computing a basic smoke generating fuel injection amount.

The flowchart of FIG. 10 illustrates a computing routine for computing a basic limitative smoke generating injection fuel amount QSMOKEN which might correspond to the limitative smoke generating fuel injection amount according to the prior art fuel injection controller. In step 1 of the flowchart in FIG. 10, information including the engine rotating speed Ne, supercharging pressure Pm (=intake pressure) detected by a supercharging pressure sensor 42 (see FIG. 1) mounted on the collecting portion 3*a*, accelerator opening degree C1, cylinder intake air amount Qac, and cylinder suction ERG gas amount Qec is read by the control unit 41.

Figure 11:
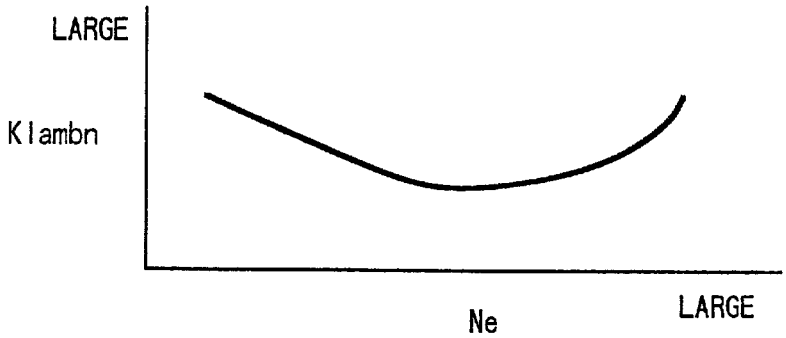
FIG. 11 is a graph indicating a table characteristic of a limitative excess coefficient during no supercharging.
Figure 12:
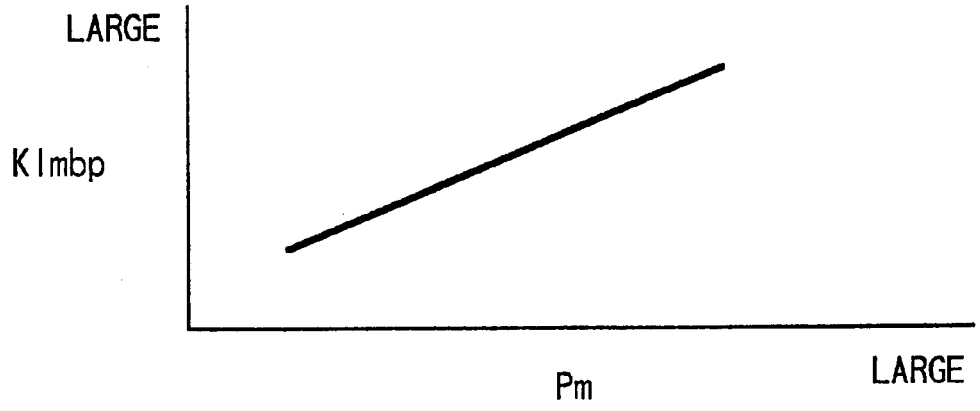
FIG. 12 is a graph indicating a table characteristic of a supercharging pressure correction factor with respect to the limitative excess coefficient.
Figure 13:
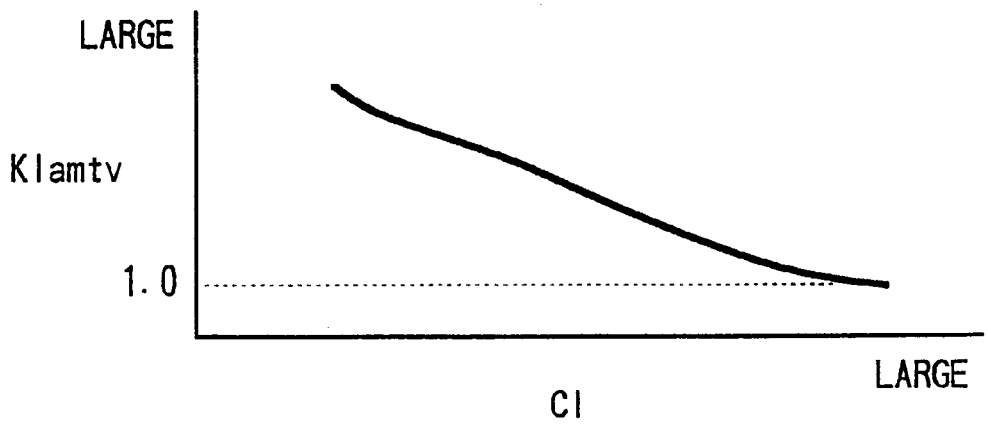
FIG. 13 is a graph indicating a table characteristic of an accelerator opening degree correction factor with respect to the limitative excess coefficient.

In steps 2 through 4, the table indicated in FIG. 11 is searched on the basis of the Ne read in step 1 to conduct computation of a limitative excess coefficient Klambn upon no supercharging, subsequently the table indicated in FIG. 12 is searched on the basis of the Pm read in step 1 to conduct computation of supercharging pressure correction factor Klambp to be applied to the limitative excess coefficient, and further the table indicated in FIG. 13 is searched on the basis of the C1 read in step 1 to conduct computation of accelerator opening degree correction factor Klamtv to be applied to the limitative excess coefficient. Then, in step 5, a limitative excess coefficient Klamb upon no supercharging as well as supercharging is computed according to an equation (5) below, by using the above computed Klambn, Klambp and Klamtv.

$$Klamb = Klambn \times Klambp \times Klamtv \quad (5)$$

At this stage, it should be noted that the limitative excess coefficient Klambn upon no supercharging corresponds to an excess coefficient which determines a smoke generating limit upon no supercharging, and indicates an increase in its value when the engine rotating speed Ne is in a high speed region.

When the supercharging pressure Pm is increased so as to increase air density, the injecting force of fuel mist injected into each cylinder is weakened due to the increase in the air density, to thereby cause a reduction in the rate of use of air. Thus, the limitative excess coefficient of the air, which determines the smoke generating limit, is reduced. Therefore, as shown in the graph of FIG. 12, the supercharging pressure correction factor Klambp is employed to make a correction such that the excess coefficient of the air is increased in response to a rise in the supercharging pressure Pm.

Further, a requested value for the limitative excess coefficient upon evaluating an exhaust emission is always different from a requested value for the limitative excess coefficient in view of a drivability of a vehicle, i.e., an accelerating performance of the vehicle, and the former requested value is larger than the latter requested value. Thus, the accelerator opening degree correction factor Klamtv is newly introduced and employed to appropriately deal with the above difference in the required values for the limitative excess coefficient. Namely, as will be understood from the graph of FIG. 13, the accelerator opening degree correction factor Klamtv is employed so as to increase the limitative excess coefficient when the exhaust emission is evaluated where the accelerator opening degree is rather small. The accelerator opening degree correction factor Klamtv is also employed so as to reduce the limitative excess coefficient when the accelerator opening degree is large due to accelerating of the vehicle and so forth.

In step 6 of the flowchart of FIG. 10, the computed limitative excess coefficient Klamb upon no supercharging as well as supercharging, the cylinder intake air amount Qac, and the cylinder suction ERG gas amount Qec are used for computing a basic limitative smoke generating fuel injection amount QSMOKEN from a limitative smoke generating fuel injection amount upon both no supercharging and supercharging according to an equation (6) below.

$$QSMOKEN=\{(Qac+Qec\times KOR)/Klamb\}/14.7 \quad (6)$$

where KOR is a residual fresh intake air ratio (constant).

The (Qec×KOR) on the right side of the equation (6) indicates an amount of fresh intake air remaining in ERG gas. In the case of the engine in which the combustion is conducted under a condition such that excessive intake air is supplied into each cylinder, a lot of oxygen component is contained in the ERG gas, and accordingly the above Qec×KOR is placed so as to take the fresh intake component in the ERG gas into consideration. Therefore, the (Qac+Qec×KOR) of the equation (6) indicates a total amount of the fresh intake amount per a cylinder, and the basic limitative smoke generating fuel injection amount QSMOKEN is computed as an amount in proportion to the total amount of the fresh intake air.

Figure 14:
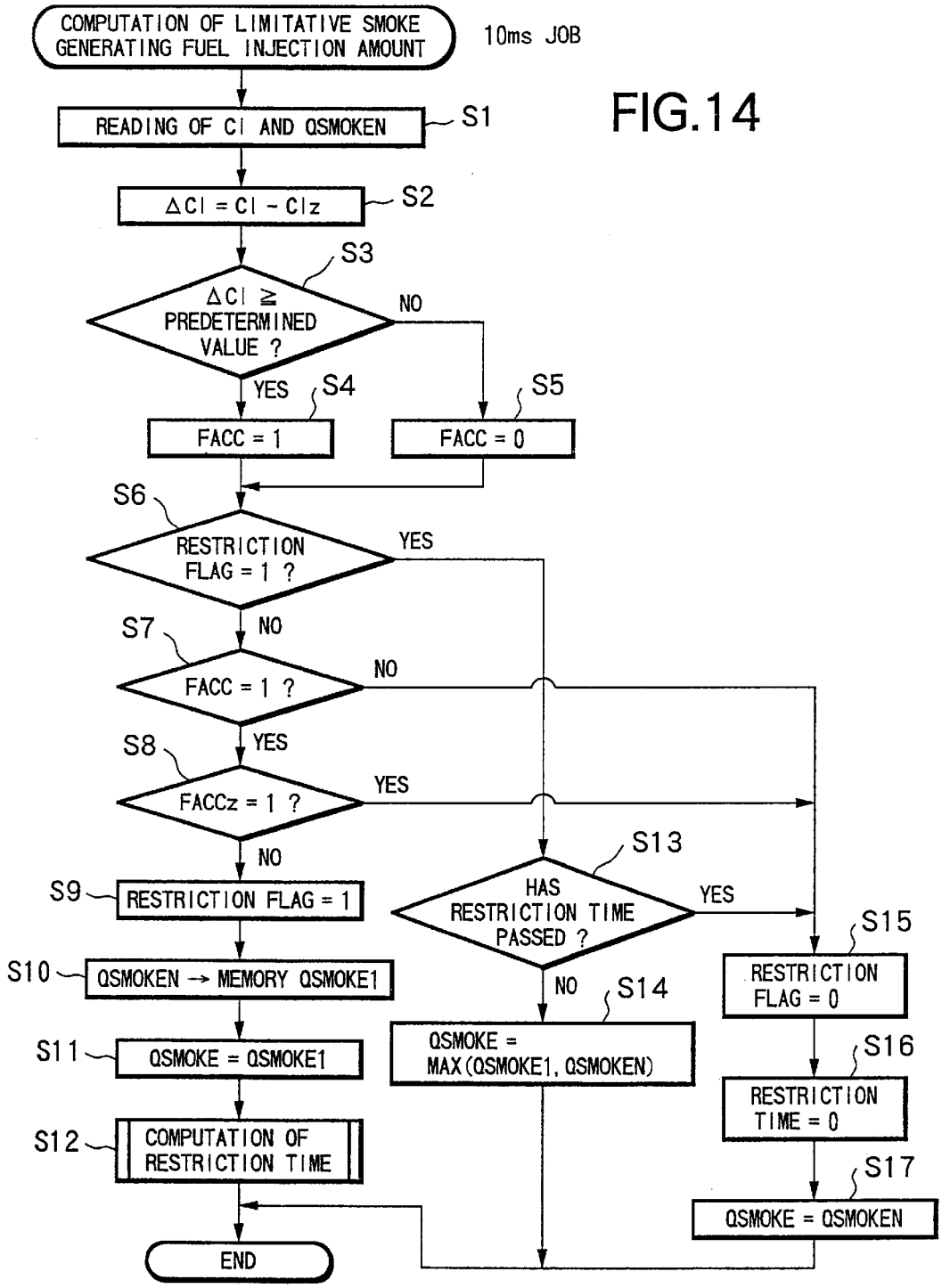
FIG. 14 is a flowchart illustrating a computing routine for computing a limitative smoke generating fuel injection amount.

The flowchart of FIG. 14 illustrates a computing routine for computing the smoke generating fuel injection amount QSMOKE upon accelerating of a vehicle in addition to the supercharging operation of the vehicle, and the computing routine is repeatedly conducted every predetermined time, for example, every 10 milliseconds. It should be understood that since the computing routine upon decelerating of a vehicle is substantially the same as that upon accelerating of the vehicle, the description is provided below with respect to only the case of accelerating of the vehicle.

In step 1 of the flowchart in FIG. 14, reading of the accelerator opening degree C1, the basic limitative smoke generating fuel injection amount QSMOKEN, and the objective fuel injection amount Qsol1 is conducted by the control unit 41.

In step 2, a change ΔC1 in an amount of the accelerator opening degree C1 for a predetermined time, e.g., 10 milliseconds corresponding to the computation cycle, is computed by an equation $$\Delta C1=C1-C1z$$

where C1z is the amount of accelerator opening degree at the preceding computing time. The computed change ΔC1 is compared with a predetermined value (a predetermined positive value) in step 3. When ΔC1 is equal to or larger than the predetermined value, it is judged that there is a requirement for accelerating of a vehicle. Thus, in step 4, an acceleration judging flag FACC is set at 1. On the other hand, when the ΔC1 is smaller than the predetermined value, the computing routine is advanced to step 5 where the acceleration judging flag FACC is set at 0.

In step 6, a restricting flag (the initial set value is 0) is checked. Now a consideration is made as to a case where the restricting flag=0. Then, the routine is forwarded from step 6 to steps 7 and 8 to check the acceleration judging flag FACC at the present time and the acceleration judging flag FACCz at the preceding time.

When FACC=1, and the FACCz=0, it is considered that a request of acceleration is made for the first time at the present time. Thus, the routine is further forwarded to steps 9*a* and 10 to set the restricting flag at 1(the restricting flag=1), and to shift the basic limitative smoke generating injection fuel amount QSMOKEN at that time to a memory (RAM) so that the QSMOKEN is stored therein. If the above memory is identified as QSMOKE1, the information or content stored in the memory QSMOKE1 is set as a limitative smoke generating injection fuel amount QSMOKE during the vehicle driving operation including the accelerating operation stage in step 11.

Subsequently, in step 12, computing of a restricting time is conducted. The computing routine of the restricting time is clearly shown in the flowchart of FIG. 15 as a sub routine of the step 12 of FIG. 14. In step 1 of the flowchart of FIG. 15, reading of an engine rotating speed Ne and ERG ratio Megrd is conducted. At this stage, computation of the actual ERG ratio Megrd is conducted according to a computing routine shown in the flowchart of FIG. 16.

Figure 16:
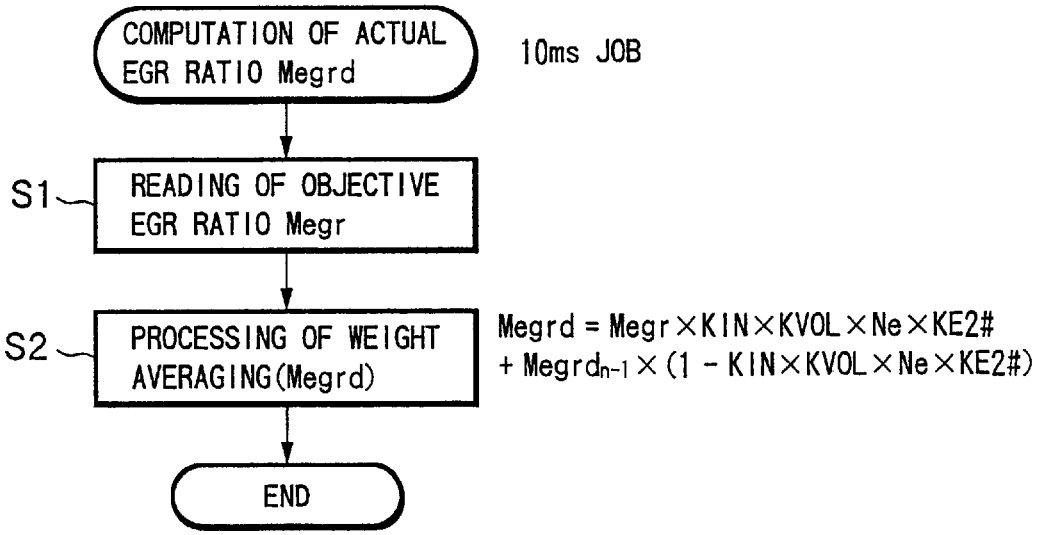
FIG. 16 is a flowchart illustrating a procedure to compute a real ratio of ERG.

Referring to FIG. 16, an objective ERG ratio Megr is read in step 1, and computation of ERG ratio Megrd at the position of au intake valve is conducted in step 2 according to an equation (7) below. The computation of step 2 is performed to simultaneously apply a delay processing and a unit converting processing (processing for converting an amount as per a cylinder to another amount as per a unit time) to the Megr in step 1.

$$Megrd = Megr\times KIN\times KVOL\times Ne\times KE2\# + Megrdn-1\times(1-KIN\times KVOL\times Ne\times KE2\#) \quad (7)$$

where KIN is a value corresponding to a volumetric efficiency, KVOL is VE/NC/VM, VE is an amount of an exhaust gas from the engine, NC is a number of cylinders of the engine, VM is a volume of the entire intake system, KE2# is a constant, and Megrdn-1 is the Megrd at the preceding time.

The portion (Ne×KE2#) on the right side of the equation (7) is an item to apply the unit converting processing. The Megrd is a value responding to the objective ERG ratio Megr with a primary delay, and accordingly the Megrd can be understood as a real ERG ratio.

Figure 15:
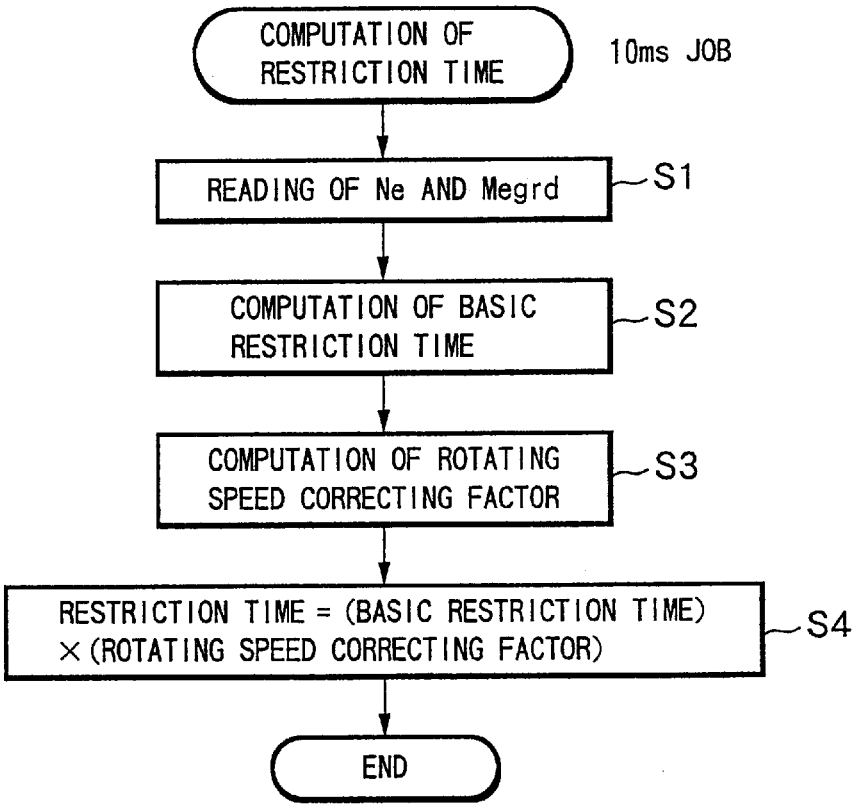
FIG. 15 is a flowchart illustrating a computing routine for computing a restricting time.
Figure 17:
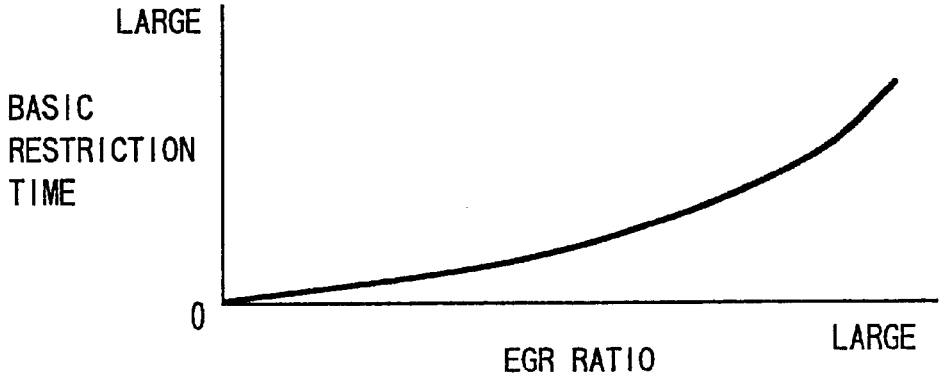
FIG. 17 is a graph indicating a table characteristic of a basic restricting time.

Reverting now to the flowchart of FIG. 15, the table of FIG. 17 indicating the relationship between the ERG ratio (the abscissa) and the basic restriction time (the ordinate) is searched on the basis of the above-mentioned actual ERG ratio Megrd in step 2 of FIG. 15 to compute the corresponding basic restriction time. Further, either the table of FIG. 18 indicated by a solid line or the table of FIG. 19 is searched on the basis of the engine rotating speed Ne to compute a rotating speed correction factor with respect to the restriction time. Subsequently, a restriction time is computed by using the above computed basic restriction time and rotating speed correction factor, according to an equation (8) below.

$$\text{Restriction time}=(\text{basic restriction time})\times(\text{rotating speed correction factor}) \quad (8)$$

At this stage, the table of FIG. 17 indicates such characteristic that the restriction time becomes long in response to an increase in the actual ERG ratio Megrd. This characteristic is selected by taking into consideration the fact that a time for which a temporary reduction in the total fresh intake air amount per a cylinder (Qac+Qec×KOR) occurs during the accelerating operation of the vehicle becomes long in response to an increase in ERG ratio. Namely, the former controlling characteristic is selected to be in harmony with the latter controlling characteristic.

Figure 18:
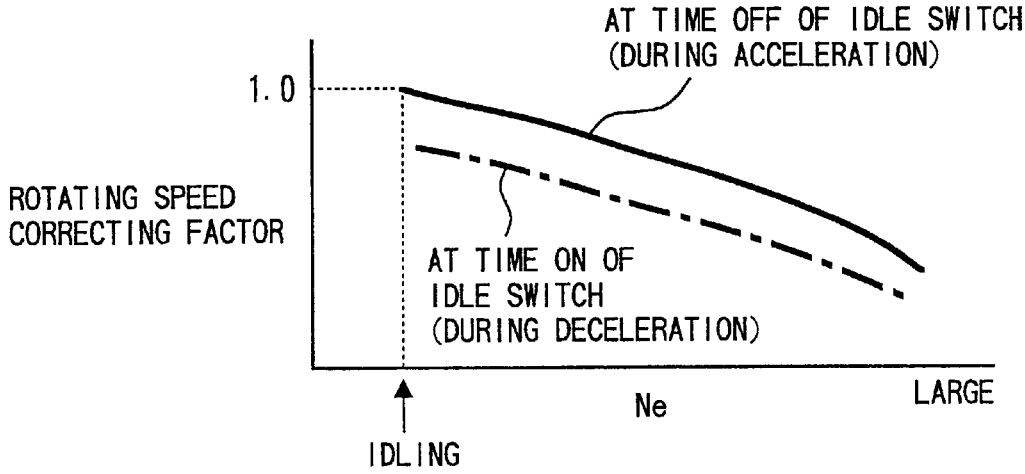
FIG. 18 is a graph indicating a table characteristic a rotating speed correction factor when a vehicle provided with a manual transmission is a controlled object.
Figure 19:
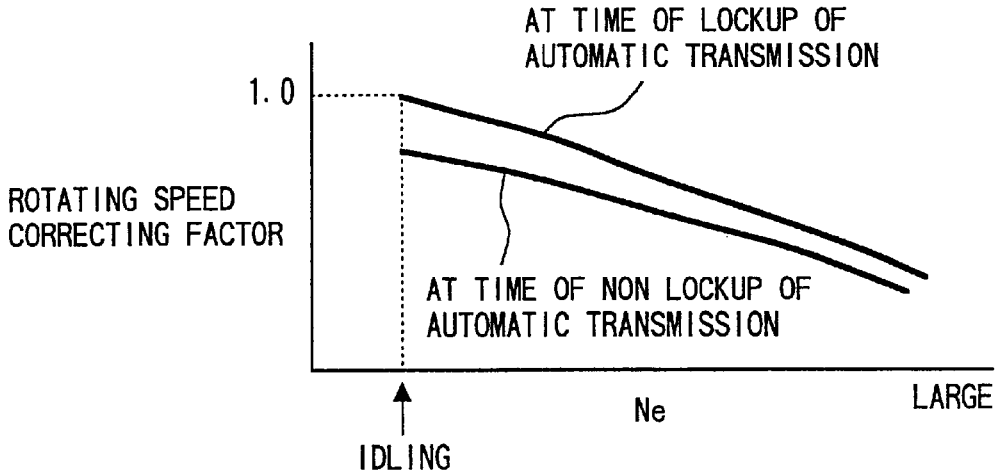
FIG. 19 is a graph indicating a table characteristic of a diesel engine rotating speed correction factor when a vehicle provided with an automatic transmission with a torque converter is a controlled object.

It should be understood that the table characteristic of FIG. 18 is applied to a vehicle provided with a manual transmission and the table characteristic of FIG. 19 is applied to a vehicle provided with a torque converter with a lockup mechanism.

Referring to the curve shown by a solid line in FIG. 18, the rotating speed correction factor takes a maximum value of "1" when the vehicle engine is operated at an idling speed, and is gradually reduced in relation to an increase in the engine rotating speed Ne. This means that the engine rotating speed correction factor is effective for correcting the restriction time in a manner such that the latter time is shortened in relation to an increase in the engine rotating speed Ne.

It is usual that the cylinder intake air amount Qac and the cylinder suction ERG gas amount Qec have a quick response property, respectively, in relation to an increase in the engine rotating speed Ne. Thus, a temporary reduction in the total fresh intake air amount per a cylinder during the accelerating operation of the vehicle occurs only for a short time. To harmonize with this characteristic, the rotating speed correction factor is provided with such a property that it is reduced in relation to an increase in the engine rotating speed Ne. The curve shown by a dot and dashed line in FIG. 18 indicates a characteristic table for the case where the vehicle is decelerated. It will be understood from FIG. 18 that the engine rotating speed correction factor during the deceleration of the vehicle is selected to be smaller than that during the acceleration of the vehicle. Namely, the curve in dot and dashed line lies below the curve in solid line. This fact can be explained as follows. Namely, since a reduction in the supercharging pressure during the decelerating of the vehicle occurs quickly more than an increase in the supercharging pressure during the accelerating of the vehicle, the restriction time during the decelerating of the vehicle can be shortened. Although the two curves of FIG. 18 indicate characteristics in a case where the vehicle engine is provided with a turbosupercharger, when the vehicle engine is operated by a natural aspiration, the characteristics of the accelerating and decelerating of the natural aspiration vehicle might be equal to one another. To the contrary, it may be possible that these two characteristics of the natural aspiration vehicle are the same as those shown in FIG. 18.

In FIG. 19, the characteristic curve during the locking-up condition of the torque converter (the automatic transmission) is similar to the characteristic curve in solid line of FIG. 18, i.e., the curve during the accelerating operation. FIG. 19 also illustrates a characteristic curve during the unlocking condition of the automatic transmission.

Figure 20:
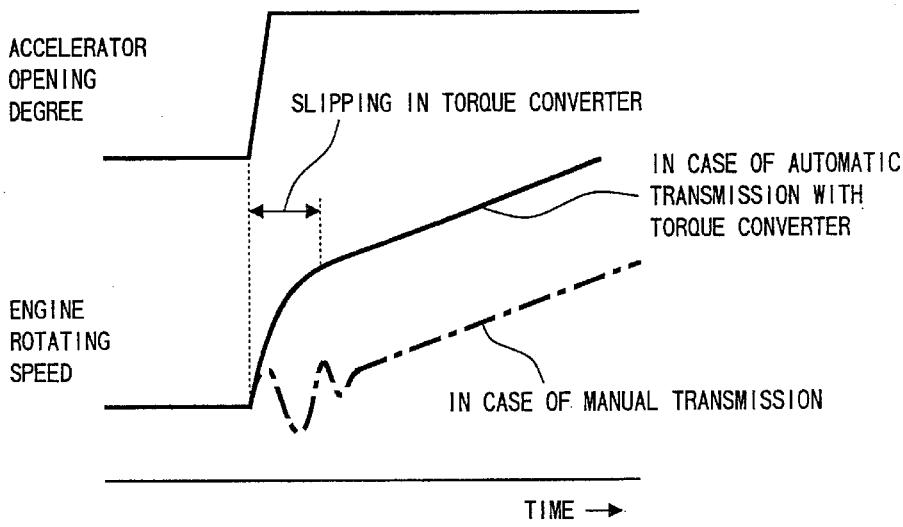
FIG. 20 is a graphical view indicating a change in a diesel engine rotating speed during accelerating of a vehicle provided with an automatic transmission with a torque converter when the vehicle is a controlled object.

From the illustration of the two curves of FIG. 19, it will be understood that the engine rotating speed ratio with respect to the unlocking condition is set to lie below that with respect to the locking-up condition. This is because since the torque converter causes a slipping during the unlocking condition thereof so that the engine is permitted to quickly increase its rotating speed (see FIG. 20), it is possible to set a shorter restriction time during the unlocking of the torque converter.

It should be understood that the characteristic curves of FIG. 19 may be applied to the fuel injection controlling operation according to the present invention, irrespective of provision of a turbosupercharger to the engine and further can be applied during the vehicle deceleration in addition to the vehicle acceleration.

As soon as the above-described operation for computing the restriction time is completed, the computation routine is returned to FIG. 14 so as to allow the computing routine of the limitative smoke generating fuel injection amount to be ended at the present time.

Due to the setting of the restriction flag at "1" in the afore-mentioned step 9 of the flowchart of FIG. 14, the routine is forwarded from step 6 to step 13 since the next time, and a time lapse after the setting "1" of the restriction flag (the restriction flag=1) and the restriction time computed in step 12 during the preceding routine are compared with one another. The measurement of the time lapse after the setting "1" of the restriction flag is conducted by a timer unit arranged in the control unit 41 (FIG. 1).

When the time lapse after switching of the restriction flag to "1" is less than the restriction time, the routine of FIG. 14 is forwarded to step 14 to compare a value in the memory QSMOKE1 with the value of the basic limitative smoke generating fuel injection amount QSMOKEN at that time. As a result of the comparison, the larger value is selected as the limitative smoke generating fuel injection amount QSMOKE. The operation of step 14 lasts until a time immediately before the elapse of the restriction time.

When the restriction time has elapsed, the routine is forwarded from step 13 to steps 15, 16 and 17 in FIG. 14, so as to reset both the restriction flag and the restriction time "0", and to set the basic limitative smoke generating fuel injection amount QSMOKEN as the limitative smoke generating fuel injection amount QSMOKE without any change.

On the other hand, when the restriction flag is "0" at step 6, the routine is forwarded from steps 7 and 8 to steps 15, 16 and 17 except for the case where FACC=1 and FACCz=1 to conduct respective computing processes according to the steps 15 through 17.

From the foregoing description, it will be understood that in a given duration from a time that the acceleration judging flag FACC is switched to "1" (the timing of judging of acceleration) to a different time that the restriction time has elapsed, the value of the memory QSMOKE1 is set as the limitative smoke generating fuel injection amount QSMOKE instead of the basic limitative smoke generating fuel injection amount QSMOKEN.

Figure 21:
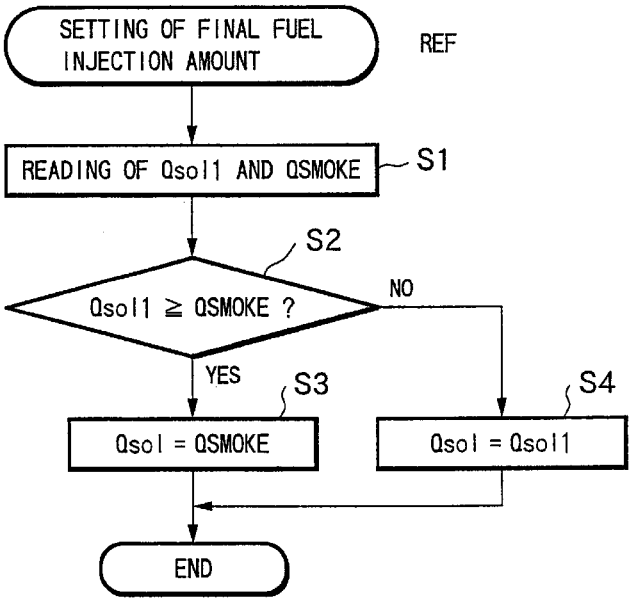
FIG. 21 is a flowchart illustrating a computing routine for setting a final fuel injection amount.

FIG. 21 illustrates a flowchart of a computation routine for computing and setting a final fuel injection amount Qsol. In step 1, the limitative smoke generating fuel injection amount QSMOKE and the objective fuel injection amount Qsol1 obtained by the afore-mentioned computation routine are read by the control unit 41. The read information of the QSMOKE and Qsol1 are subsequently compared with one another in step 2.

When the Qsol1 is equal to or larger than the QSMOKE, the routine is forwarded to step 3 where the limitative smoke generating fuel injection amount QSMOKE is set as a final fuel injection amount Qsol. The objective fuel injection amount sol1 is a map value which is basically determined depending on the engine rotating speed Ne and the accelerator opening degree C1, and even when this map value is larger than the limitative smoke generating fuel injection amount QSMOKE at that time, if the objective fuel injection amount Qsol1 is directly charged into the engine, generation of smoke will surely occurs. Thus, the limitative smoke generating fuel injection amount QSMOKE is employed as a limiting value to determine an upper limit of the fuel injection amount.

When the above-mentioned map value is below the limitative smoke generating fuel injection amount QSMOKE, introduction of the limiting value is not required, and accordingly the routine is forwarded from step 2 to step 4 so that the objective fuel injection amount Qsol1 is set as the final fuel injection amount Qsol.

At this stage, it should be understood that although there are a variety of methods of controlling the opening degree of the ERG valve 6 by employing the objective ERG ratio, the advantageous features according to the present invention does not rely on the controlling method of the opening degree of the ERG valve 6. Therefore, a description of such controlling method will be omitted herein. However, for example, the disclosure of Japanese Patent Application Nos. 10-31460, 11-44754 and 11-233124 will be hereby incorporated herein by only reference to understand the above-mentioned controlling method.

Figure 22:
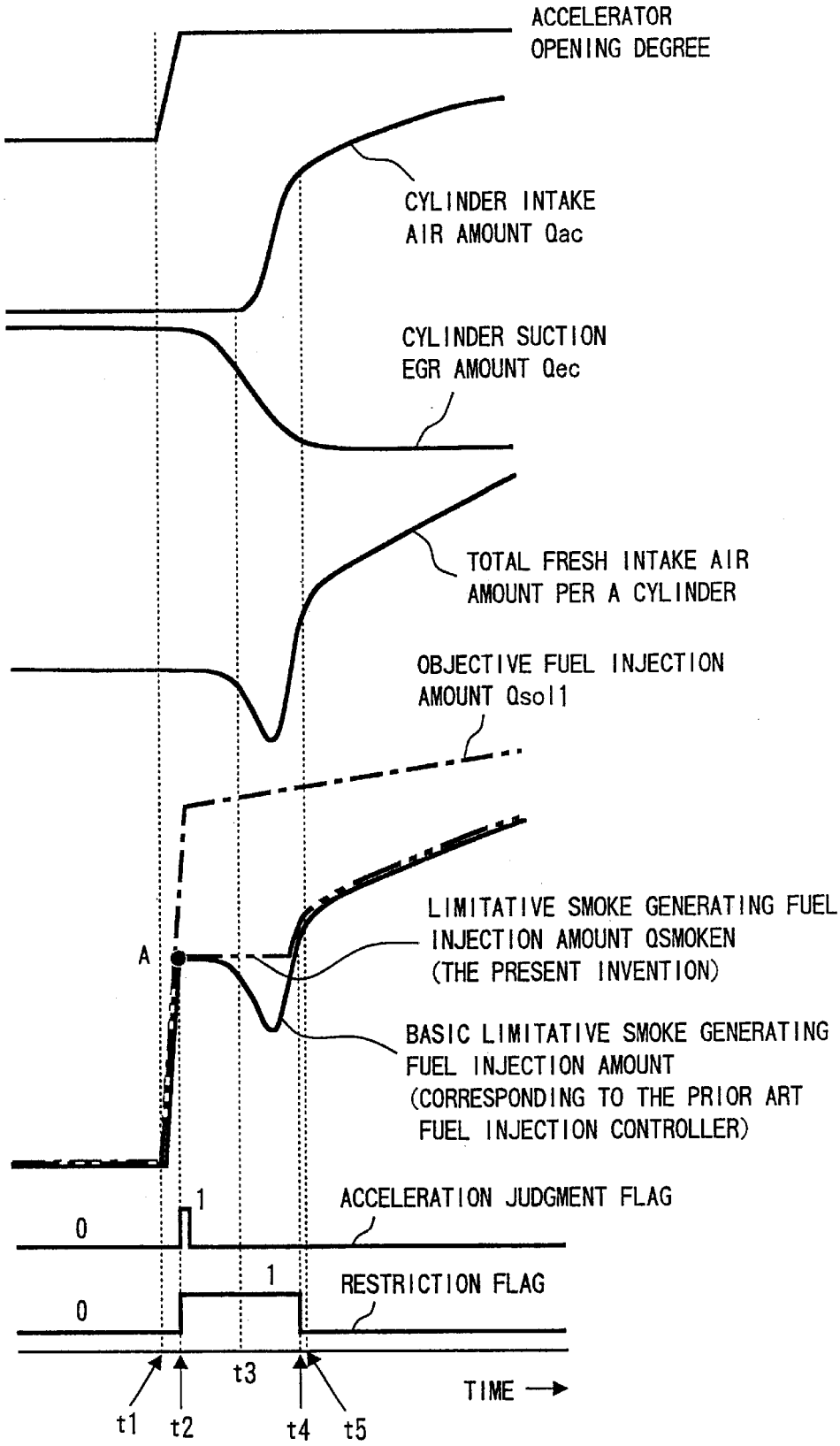
FIG. 22 is a graphical view illustrating the controlling operation during accelerating of a diesel engine; and, FIG. 23 is a graphical view illustrating the controlling operation during decelerating of a diesel engine.

The description of the operation of the present embodiment during the acceleration of the vehicle will be provided hereinbelow with reference to FIG. 22.

As stated hereinbefore, the objective fuel injection amount Qsol1 is a map value, which is basically predetermined by the engine rotating speed and the accelerator opening degree. Thus, the objective fuel injection amount Qsol1 greatly goes up while exceeding the limitative smoke generating fuel injection amount due to the acceleration of the vehicle, as shown by the characteristic curve in dot and dashed line in FIG. 22. Accordingly, during the acceleration, the limitative smoke generating fuel injection amount is employed as the final fuel injection amount Qsol that is an actual amount of fuel charged by injection to the engine. In this case, if the basic limitative smoke generating fuel injection amount QSMOKEN which corresponds to the limitative smoke generating fuel injection amount of the prior art fuel injection controller is employed, as soon as the accelerator pedal is pressed down at the time t1, the fuel injection amount to be charged to the engine will be temporarily reduced to the level according to the basic limitative smoke generating fuel injection amount QSMOKEN (see the curve of the QSMOKEN shown by the solid line in FIG. 21).

Nevertheless, in the present embodiment of the present invention, due to the change in the accelerator opening degree, the acceleration judging flag FACC will be switched from "0" to "1" at the time t2. Then, the value of the basic limitative smoke generating fuel injection amount QSMOKEN at the time t2 (the value "A" in FIG. 22) will be stored in the memory QSMOKEN1, and also the restriction flag will be switched from "0" to "1". Thus, from the time t2, a larger one of the value "A" stored in the memory QSMOKEN1 and the basic limitative smoke generating fuel injection amount QSMOKEN is selected as the limitative smoke generating fuel injection amount QSMOKE. Thus, the fuel injection to the engine is carried out by the QSMOKE for a time period during which the restriction flag is maintained at "1". Namely, according to the present embodiment, from the accelerating judging timing t2, the value of the memory QSMOKE1 is constantly held as the limitative smoke generating fuel injection amount QSMOKE as indicated by the curve shown by a dot and dashed line in FIG. 22. Accordingly, during acceleration, no temporary reduction in the amount of fuel injection occurs so that the engine operation can afford to avoid any unfavorable torque variation. Therefore, when either a vehicle provided with a manual transmission is accelerated or a vehicle provided with an automatic transmission including a torque converter with a lockup mechanism and a gear changer is accelerated under a lockup condition of the torque converter, the accelerating drivability of the vehicle cannot be deteriorated When the restriction time has passed, the basic limitative fuel injection amount QSMOKEN which corresponds to the limitative smoke generating fuel injection amount employed by the prior art fuel injection controller is set as the final injection amount Qsol1 which indicates an actual amount of fuel supplied by injection to respective engine cylinders. Thus, even after lapse of the restriction time, smoke generation can be avoided in a manner similar to the prior art fuel injection controller.

The operation of the fuel injection controller according to the present embodiment under a condition where the ERG operation is stopped will be described as follows. Namely, when the ERG operation is stopped, ERG ratio is "0" in the characteristic curve of FIG. 17. Accordingly, the basic restriction time is also "0". This means that the left side of the equation (8), i.e., the restriction time becomes "0". Therefore, when the vehicle is accelerated during stopping of the ERG operation, the computation of the limitative smoke generating fuel injection amount results in that the limitative smoke generating fuel injection amount should be set as the basic limitative fuel injection amount QSMOKEN corresponding to the limitative smoke generating fuel injection amount of the prior art fuel injection controller (see the computation routine in FIG. 14).

Figure 23:
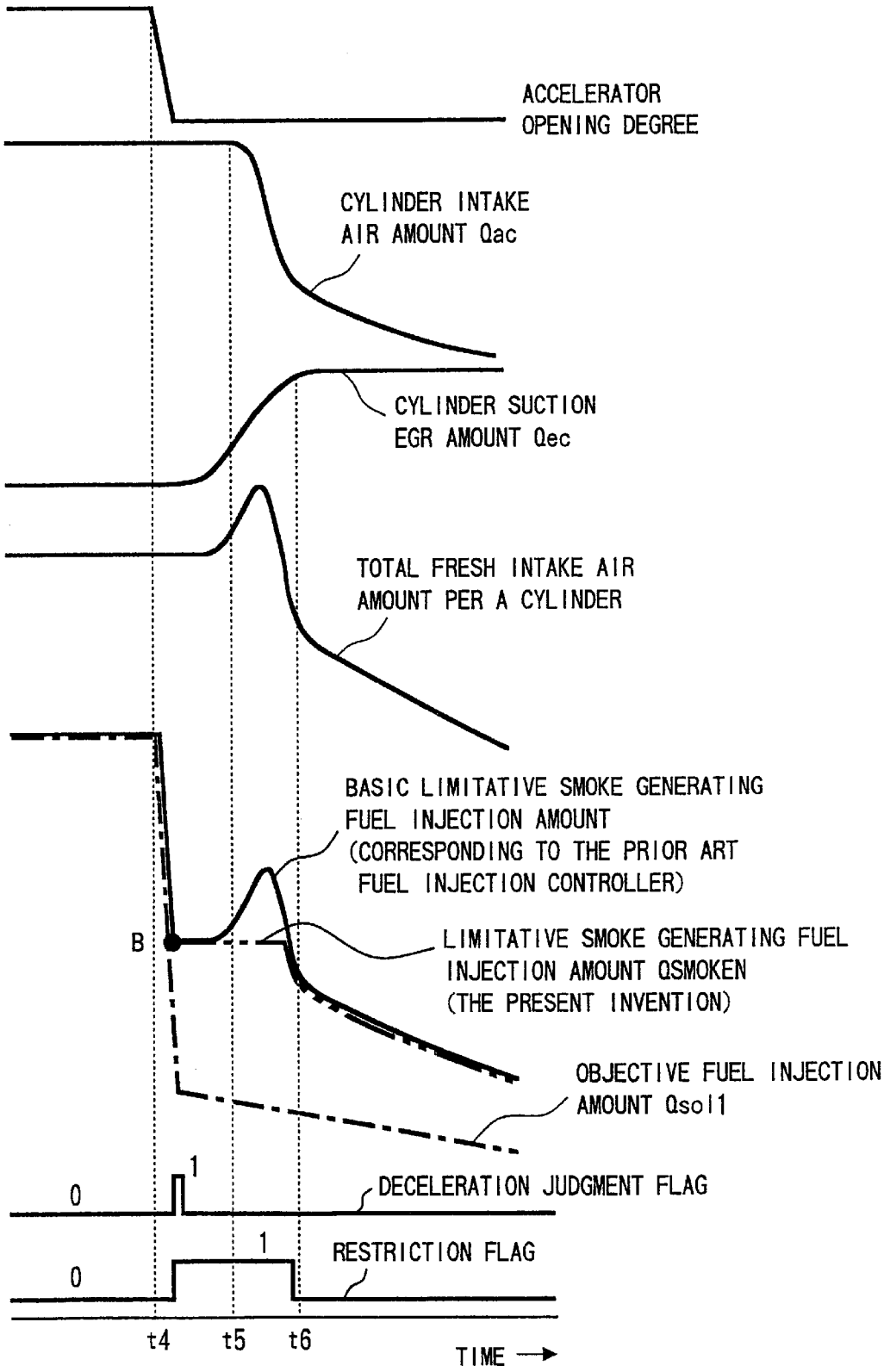

Referring to FIG. 23, which illustrates the operation of the fuel injection controller during deceleration, the basic limitative fuel injection amount QSMOKEN has a characteristic such that a temporary increase appears as clearly understood by a fifth solid line curve from the top. Nevertheless, the objective fuel injection amount Qsol1 during the deceleration shown by a dot and dashed line curve lies far below the basic limitative smoke generating fuel injection amount QSMOKEN, and accordingly the objective fuel injection amount Qsol1 during the deceleration is not limited by the QSMOKEN that defines an upper limiting value of the amount of fuel injection.

However, when the vehicle operation is subjected to acceleration immediately after deceleration, although a temporary increase appears in the curve of the basic limitative smoke generating fuel injection amount QSMOKEN due to a response delay of the intake air, the curve of the objective fuel injection amount Qsol1 that is a map value according to the operating conditions of the vehicle such as the engine rotating speed, the accelerator opening degree, and so forth, exhibits a characteristic such that the Qsol1 immediately increases in response to the acceleration immediately after deceleration. Therefore, the objective fuel injection amount Qsol1 might exceed the basic limitative smoke generating fuel injection amount QSMOKEN. Then, the basic limitative fuel injection amount QSMOKEN per se is employed as the limitative smoke generating fuel injection amount to be used as an actual amount of fuel supplied by injection to the respective cylinders of the engine.

When the basic limitative smoke generating fuel injection amount QSMOKEN corresponding to the limitative fuel injection amount of the prior art fuel injection controller is employed, during the accelerating operation of the vehicle, the upper limit of the fuel injection amount changes so as to be gradually reduced while suppressing smoke generation. Unlike the above situation, when the vehicle is subject to acceleration immediately after deceleration, the upper limit of the amount of fuel injection changes so as to be gradually increased while failing in suppression of smoke generation. Thus, torque shock occurs to be sensed by the vehicle operator. Further, unfavorable smoke generation due to a temporary increase in the fuel injection amount occurs.

In order to improve the above situation, the present embodiment of the present invention implements a novel fuel injection controlling as described below when the vehicle is subjected to acceleration immediately after deceleration with reference to the graphical illustration of FIG. 23.

Referring to FIG. 23, when the deceleration judging flag is switched from "0" to "1" at a specified time during the deceleration, in response to a change in the accelerator opening degree, the basic limitative smoke generating fuel injection amount QSMOKEN (a value at the timing Shown by "B" in FIG. 23) at the specified time is stored in the memory QSMOKE1, and the restriction flag is switched from "0" to "1". Thus, during a time period after the specified time, the smaller one of the value "B" stored in the memory QSMOKE1 and the basic limitative smoke generating fuel injection amount QSMOKEN is selected as the limitative smoke generating fuel injection amount QSMOKE, and this selection lasts for a time period during which the restriction flag maintains "1". Namely, in the present embodiment, like the acceleration of the vehicle, when the vehicle is subjected to acceleration immediately after deceleration, the limitative smoke generating fuel injection amount QSMOKE is constantly held at the value of the memory QSMOKE1 from the time of the judgment of deceleration. Thus, during the acceleration immediately after the deceleration any increase in the fuel injection amount does not occur while surely avoiding a change in the engine output torque. Therefore, either when a vehicle provided with a manual transmission is subjected to acceleration immediately after deceleration or when a vehicle provided with an automatic transmission including a torque converter with a lockup mechanism and a gear changer is subjected to acceleration immediately after deceleration under a lockup condition of the torque converter, any deterioration in both the drivability of the vehicle as well as smoke-generation suppressing performance can be avoided.

Although the foregoing description of the embodiment is made with reference to an exemplary case where the judgment of acceleration and deceleration of a vehicle is performed depending on the accelerator opening degree of the vehicle, it should be understood that the present invention is not intended to be limited by the described embodiment. For example, judgment of acceleration and deceleration of a vehicle may be made depending on a change in an objective fuel injection amount or an engine rotating speed. Alternately, an embodiment may be adopted in which an accelerometer directly detecting acceleration of a vehicle is used.

In the described embodiment, the basic restriction time is set according to an actual ERG ratio Megrd. However, an objective ERG ratio Megr in place of the Megrd may be employed.

Further, in the described embodiment, although the description is made with reference to the case where a diesel engine is provided with a turbosupercharger, the present invention is not limited by this embodiment. Thus, an embodiment may be adopted in which a diesel engine with a natural aspiration mechanism may be controlled by the fuel injection controller of the present invention.

Furthermore, although the foregoing description of the embodiment is made with reference to a case where the burning pattern in the engine is single stage combustion in which a low-temperature premised combustion is carried out in the engine. However, it should be understood that the present invention might be applied to a diesel engine in which diffusion combustion is added after the premixed combustion.

This application claims priority of Japanese Patent Application No. 2000-174945. The entire description of the Japanese Patent Application No. 2000-174945 is hereby incorporated herein by reference.

Having described the present invention as related to a specific preferred embodiment shown in the accompanying drawings, it should be understood that modification and variation of the present invention will be made without departing from the spirit and scope of the invention as claimed in the accompanying claims. Further, the foregoing description of the embodiment according to the present invention is provided for illustration only, and not for the purpose of limiting the invention as defined by the accompanying claims and their equivalents.

What is claim is:

1. A fuel injection controlling system for a diesel engine provided with an intake passage for intake air, a fuel supply system for fuel injected in an engine cylinder, and an EGR passage for exhaust gas recirculation, said fuel injection controlling system comprising:

a sensor unit that detects an amount of intake air through said intake passage, an amount of exhaust gas through said EGR passage, and a transient operation condition of said engine; and a control unit including a computing unit and a memory unit and operatively connected to said sensor unit for determining an objective amount of fuel, wherein said control unit:

computes an amount of intake air entering said engine cylinder based on the detected amount of intake air;

computes a residue amount of fresh air within the detected amount of exhaust gas introduced in said engine cylinder;

obtains a sum of the computed amount of intake air and the computed residue amount of fresh air;

computes a basic limitative amount of fuel that defines a smoke generation limit based on said sum;

detects commencement of the transient operation condition;

stores said basic limitative amount of fuel at the instance in which the commencement of the transient operation condition has been detected;

compares said stored basic limitative amount of fuel to said computed basic limitative amount of fuel to obtain a desired limitative amount of fuel;

prevents said objective amount of fuel from exceeding said desired limitative amount of fuel.

2. A fuel injection controlling system for a diesel engine as set forth in claim 1, wherein when said transient operation condition of said engine is an accelerating operation of said engine, said control unit compares said stored basic limitative amount of fuel with said computed basic limitative amount of fuel to determine a larger one of said compared two basic limitative amounts of fuel as said desired limitative amount of fuel since the time of detection of said accelerating operation of said diesel engine.

3. A fuel injection controlling system for a diesel engine as set forth in claim 1, wherein when said transient operation condition of said engine is a decelerating operation of said engine, said control unit compares said stored basic limitative amount of fuel with said computed basic limitative amount of fuel to thereby determine a smaller one of said compared two basic limitative amounts of fuel as said desired limitative amount of fuel since the time of detection of said accelerating operation of said diesel engine.

4. A fuel injection controlling system for a diesel engine as set forth in claim 1, wherein said control unit conducts computation to obtain said desired basic limitative amount of fuel for a predetermined restriction time lasting from the time when it is detected that said engine comes into said transient operation.

5. A fuel injection controlling system for a diesel engine as set forth in claim 4, wherein said control unit determines as said predetermined restriction time a given duration that depends on an operating condition of said EGR passage at the time when it is detected that said engine comes into said transient operation.

6. A fuel injection controlling system for a diesel engine as set forth in claim 4, wherein said sensor unit detects an engine rotating speed and said control unit determines as said predetermined restriction time a given duration that depends on said engine rotating speed detected at the time when it is detected that said engine comes into said transient operation.

7. A fuel injection controlling system for a diesel engine as set forth in claim 4, wherein said control unit determines as said predetermined restriction time different durations that depend on a condition where a manual transmission or a torque converter is provided for a vehicle on which said engine is mounted.

8. A fuel injection controlling system for a diesel engine as set forth in claim 7, wherein when said vehicle is provided with said torque converter having therein a lockup mechanism, said control unit determines as said predetermined restriction time two different durations that depend on a condition where said lockup mechanism of said torque converter is in either a lockup condition or a non-lockup condition.

9. A fuel injection controlling system for a diesel engine as set forth in claim 4, wherein when a vehicle mounting thereon said engine is provided with a turbosupercharger, said control unit determines as said predetermined restriction time two different durations that depend on whether said transient operation condition of said engine is an accelerating operation thereof or a decelerating operation thereof.

10. A fuel injection controlling system for a multi-cylinder type diesel engine adapted to be mounted on a vehicle, said engine including an intake passage for intake air, a fuel supply system for supplying an objective amount of fuel injected in engine cylinders, and an EGR passage for exhaust gas recirculation, said fuel injection controlling system comprising:

a sensor unit detecting an operating condition of said engine, said operating condition including an amount of intake air flowing through said intake passage, an amount of exhaust gas recirculating in said EGR passage, and an acceleration operation condition of said engine;

a first computing means for computing an amount of intake air entering each of said engine cylinders on the basis of said amount of intake air detected by said sensor unit;

a second computing means for computing an amount of exhaust gas entering said engine cylinders via said EGR passage on the basis of said amount of exhaust gas detected by said sensor unit to obtain an amount of residue fresh air in the computed amount of exhaust gas of said each of said engine cylinders;

a third computing means for obtaining a sum of the amount of residue fresh air in said exhaust gas computed by said second computing means and the amount of the intake air computed by said first computing means;

a fourth computing means for computing a basic limitative amount of fuel injection per each of said engine cylinders that defines a smoke generation limit, under said obtained sum;

a storing means for storing said basic limitative amount of fuel that is computed by said fourth computing means, at a moment when said detecting means detects that said engine comes into said accelerating operation;

a means for comparing said stored basic limitative amount of fuel at the moment of detection of said accelerating operation with said basic limitative amount of fuel computed by said fourth computing means to thereby determine a larger one of said compared amounts of fuel as a desired limitative amount of fuel from the time when said detecting means detects said accelerating operation of said engine;

a means for preventing said objective amount of fuel from exceeding said desired limitative amount of fuel from the time when said detecting means has detected that said engine has come into said accelerating operation thereof; and, a means for controlling said fuel supply system so that said each engine cylinder is supplied with said objective amount of fuel injection during said accelerating operation of said engine.

11. A fuel injection controlling system for a multi-cylinder type diesel engine adapted to be mounted on a vehicle, said engine including an intake passage for intake air, a fuel supply system for supplying an objective amount of fuel injected in engine cylinders, and an EGR passage for exhaust gas recirculation, said fuel injection controlling system comprising:

a sensor unit detecting an operating condition of said engine, said operating condition including an amount of intake air flowing through said intake passage, an amount of exhaust gas recirculated through said EGR passage, and a decelerating operation condition of said engine;

a first computing means for computing an amount of intake air entering each of said engine cylinders on the basis of said amount of intake air detected by said sensor unit;

a second computing means for computing an amount of exhaust gas entering said engine cylinders via said exhaust gas recirculation passage on the basis of said amount of exhaust gas detected by said sensor unit to obtain an amount of residue fresh air in the computed amount of exhaust gas;

a third computing means for obtaining a sum of the amount of residue fresh air in said exhaust gas computed by said second computing means and the amount of the intake air computed by said first computing means;

a fourth computing means for computing a basic limitative amount of fuel per each of said engine cylinders that defines a smoke generation limit, under said obtained sum;

a storing means for storing said basic limitative amount of fuel that is computed by said fourth computing means, at a moment when said detecting means detects that said engine comes into said decelerating operation of said engine;

a means for comparing said stored basic limitative amount of fuel at the moment of detection of said decelerating operation with said basic limitative amount of fuel computed by said fourth computing means to thereby determine a smaller one of said compared amounts of fuel as a desired limitative amount of fuel from the time when said detecting means detects said decelerating operation of said engine;

a means for preventing said objective amount of fuel from exceeding said desired limitative amount of fuel from the time when said detecting means has detected that said engine has come into said decelerating operation thereof; and, a means for controlling said fuel supply system so that said each engine cylinder is supplied with said objective amount of fuel during said decelerating operation of said engine.

12. A method of controlling fuel injection for a diesel engine provided with a fuel supply system for supplying fuel to be injected toward a diesel engine cylinder, comprising:

providing said engine cylinder with an exhaust gas upon being recirculated from said engine;

detecting an engine operating condition including an amount of intake air flowing in an intake passage, an amount of said recirculated exhaust gas, and a transient operation condition of said engine;

computing an amount of intake air entering said engine cylinder on the basis of said amount of intake air;

computing an amount of exhaust gas recirculated into said engine cylinder on the basis of said amount of said detected recirculated exhaust gas to obtain a residue amount of fresh air that remains in said computed amount of exhaust gas;

determining a total amount of fresh intake air per said engine cylinder from a result of computation to obtain a sum of said residue amount of fresh air remaining in said computed amount of exhaust gas and the computed amount of intake air;

computing a basic limitative amount of fuel that defines a smoke generation limit, under said total amount of fresh air per said engine cylinder;

storing said basic limitative amount of fuel at a moment when it is detected that said engine comes into a transient operation on the basis of said detected engine operating condition;

comparing said stored basic limitative amount of fuel and said computed basic limitative amount of fuel to thereby obtain a desired limitative amount of fuel from the time when said engine has come into said transient operation;

preventing an objective amount of fuel from exceeding said desired limitative amount of fuel injection from the time when said engine comes into said transient operation thereof; and, controlling said fuel supply system so that said engine is supplied with said objective amount of fuel injection during said transient operation of said engine.

13. A method as set forth in claim 12, wherein when it is detected that said transient operation condition of said engine is an accelerating operation, said comparing of said stored basic limitative amount of fuel with said computed basic limitative amount of fuel is conducted so as to determine a larger one of said compared amount of fuel as said desired amount of fuel during said accelerating operation of said engine.

14. A method as set forth in claim 12, wherein when it is detected that said transient operation condition of said engine is a decelerating operation, said comparing of said stored basic limitative amount of fuel with said computed basic limitative amount of fuel is conducted so as to determine a smaller one of said compared two basic limitative amounts of fuel as said desired limitative amount of fuel during said decelerating operation of said engine.

15. A fuel injection controlling system for a multi-cylinder diesel engine having a plurality of engine cylinders, an intake passage for permitting intake air to flow toward the engine cylinders, and an EGR passage for recirculating an exhaust gas into said engine cylinders, comprising:

a sensor unit for detecting an operating condition of said engine, said sensor unit including a first sensor for detecting an amount of intake air flowing in said intake passage, a second sensor for detecting an amount of said exhaust gas flowing in the EGR passage, and a third sensor for detecting a transient operation of said engine;

a controlling unit computing an objective amount of fuel injection for each of said plurality of engine cylinders on the basis of detected signals of said sensor unit; and, a fuel injection unit supplying each of said plurality of engine cylinders with a fuel by injection, according to said objective amount of fuel injection, wherein said controlling unit computes a sum of an amount of intake air for each of said engine cylinders and an amount of residue fresh air for each of said engine cylinders, which remains in said exhaust gas without being subjected to combustion;

computes a basic limitative amount of fuel injection for each of said engine cylinders which is capable of suppressing generation of smoke in said exhaust gas, under said computed sum of fresh air for each said engine cylinder, to thereby prevent said objective amount of fuel injection from exceeding said computed basic limitative amount of fuel injection;

stores said basic limitative amount of fuel injection at a moment of detection of the commencement of said transient operation of said engine;

compares said stored basic limitative amount of fuel injection with said computed basic limitative amount of fuel injection for a predetermined duration since said moment of detection of said commencement of said transient operation condition of said engine, to thereby select a given one of said compared two basic limitative amount of fuel injection as a desired limitative amount of fuel injection; and, prevents said objective amount of fuel injection from exceeding said desired limitative amount of fuel injection during said transient operation condition of said engine.

* * * * *